US007203638B2

(12) United States Patent
Jelinek et al.

(10) Patent No.: US 7,203,638 B2
(45) Date of Patent: Apr. 10, 2007

(54) METHOD FOR INTEROPERATION BETWEEN ADAPTIVE MULTI-RATE WIDEBAND (AMR-WB) AND MULTI-MODE VARIABLE BIT-RATE WIDEBAND (VMR-WB) CODECS

(75) Inventors: Milan Jelinek, Québec (CA); Redwan Salami, Québec (CA)

(73) Assignee: Nokia Corporation, Espoo (FI)

( * ) Notice: Subject to any disclaimer, the term of this patent is extended or adjusted under 35 U.S.C. 154(b) by 43 days.

(21) Appl. No.: 11/039,540

(22) Filed: Jan. 19, 2005

(65) Prior Publication Data

US 2005/0267746 A1 Dec. 1, 2005

Related U.S. Application Data

(63) Continuation of application No. PCT/CA03/001572, filed on Oct. 10, 2003.

(51) Int. Cl.
*G10L 19/00* (2006.01)

(52) U.S. Cl. ..... 704/201; 704/215

(58) Field of Classification Search ..... None
See application file for complete search history.

(56) References Cited

U.S. PATENT DOCUMENTS

| | | | | |
|---|---|---|---|---|
| 6,631,139 | B2 * | 10/2003 | El-Maleh et al. | 370/466 |
| 7,016,834 | B1 * | 3/2006 | Lakaniemi | 704/214 |
| 2002/0083461 | A1 * | 6/2002 | Hutcheson et al. | 725/91 |
| 2002/0101844 | A1 | 8/2002 | El-Maleh et al. | 370/342 |
| 2003/0065508 | A1 * | 4/2003 | Tsuchinaga et al. | 704/215 |
| 2003/0200092 | A1 * | 10/2003 | Gao et al. | 704/258 |

FOREIGN PATENT DOCUMENTS

WO WO-01/22402 A1 3/2001

OTHER PUBLICATIONS

"Wideband coding of speech at around 16 kbit/s using Adaptive Multi-rate Wideband (AMR-WB)", ITU-T G.722.2, Jul. 2003, pp. 1-74.

(Continued)

*Primary Examiner*—V. Paul Harper
(74) *Attorney, Agent, or Firm*—Harrington & Smith, PC

(57) ABSTRACT

A source-controlled Variable bit-rate Multi-mode WideBand (VMR-WB) codec, having a mode of operation that is interoperable with the Adaptive Multi-Rate wideband (AMR-WB) codec, the codec comprising: at least one Interoperable full-rate (I-FR) mode, having a first bit allocation structure based on one of a AMR-WB codec coding types; and at least one comfort noise generator (CNG) coding type for encoding inactive speech frame having a second bit allocation structure based on AMR-WB SID_UPDATE coding type. Methods for i) digitally encoding a sound using a source-controlled Variable bit rate multi-mode wideband (VMR-WB) codec for interoperation with an adaptative multi-rate wideband (AMR-WB) codec, ii) translating a Variable bit rate multi-mode wideband (VMR-WB) codecsignal frame into an Adaptive Multi-Rate wideband (AMR-WB) signal frame, iii) translating an Adaptive Multi-Rate wideband (AMR-WB) signal frame into a Variable bit rate multi-mode wideband (VMR-WB) signal frame, and iv) translating an Adaptive Multi-Rate wideband (AMR-WB) signal frame into a Variable bit rate multi-mode wideband (VMR-WB) signal frame are also provided.

63 Claims, 12 Drawing Sheets

OTHER PUBLICATIONS

"CDMA 2000 Wideband Speech Codec, Stage 1 Requirements", 3GPP2 S. R0080-0, Version 1.0, Feb. 20, 2003, 15 pages.

"Adaptive Multi-Rate-Wideband (AMR-WB) speech codec; Comfort noise aspects (Release 6)", 3GPP TS 26.192 V6.0.0, Dec. 2004, pp. 1-14.

"Adaptive Multi-Rate-Wideband (AMR-WB) speech codec; Source controlled rate operation (Release 6)", 3GPP TS 26.193, V6.0.0, Dec. 2004, pp. 1-21.

Signal Modification For Voiced Wideband Speech Coding And Its Application For IS-95 System, Mikko Tommi et al., IEEE 2002, 3 pages.

"Robust Signal/Noise Discrimination For Wideband Speech And Audio Coding", M. Jelinek, et al., IEEE, Sep. 2000, 3 pages.

"Transform Coding of Audio Signals Using Perceptual Noise Criteria", James D. Johnston, IEEE 1988, vol. 6., No., pp. 314-323.

* cited by examiner

METHOD FOR INTEROPERATION BETWEEN ADAPTIVE MULTI-RATE WIDEBAND (AMR-WB) AND MULTI-MODE VARIABLE BIT-RATE WIDEBAND (VMR-WB) CODECS

CROSS REFERENCE TO RELATED APPLICATION

This application is a continuation of International Patent Application No. PCT/CA2003/001572 filed on Oct. 10, 2003.

FIELD OF THE INVENTION

The present invention relates to digital encoding of sound signals, in particular but not exclusively a speech signal, in view of transmitting and synthesizing this sound signal. In particular, the present invention relates to a method for interoperation between adaptive multi-rate wideband and multi-mode variable bit-rate wideband codecs.

BACKGROUND OF THE INVENTION

Demand for efficient digital narrowband and wideband speech coding techniques with a good trade-off between the subjective quality and bit rate is increasing in various application areas such as teleconferencing, multimedia, and wireless communications. Until recently, telephone bandwidth constrained into a range of 200–3400 Hz has mainly been used in speech coding applications. However, wideband speech applications provide increased intelligibility and naturalness in communication compared to the conventional telephone bandwidth. A bandwidth in the range 50–7000 Hz has been found sufficient for delivering a good quality giving an impression of face-to-face communication. For general audio signals, this bandwidth gives an acceptable subjective quality, but is still lower than the quality of FM radio or CD that operate on ranges of 20–16000 Hz and 20–20000 Hz, respectively.

A speech encoder converts a speech signal into a digital bit stream, which is transmitted over a communication channel or stored in a storage medium. The speech signal is digitized, that is, sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a sound signal.

Code-Excited Linear Prediction (CELP) coding is a well-known technique allowing achieving a good compromise between the subjective quality and bit rate. This coding technique is a basis of several speech coding standards both in wireless and wireline applications. In CELP coding, the sampled speech signal is processed in successive blocks of L samples usually called frames, where L is a predetermined number corresponding typically to 10–30 ms. A linear prediction (LP) filter is computed and transmitted every frame. The computation of the LP filter typically needs a lookahead, a 5–15 ms speech segment from the subsequent frame. The L-sample frame is divided into smaller blocks called subframes. Usually the number of subframes is three or four resulting in 4–10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of the LP filter.

In wireless systems using code division multiple access (CDMA) technology, the use of source-controlled variable bit rate (VBR) speech coding significantly improves the system capacity. In source-controlled VBR coding, the codec operates at several bit rates, and a rate selection module is used to determine the bit rate used for encoding each speech frame based on the nature of the speech frame (e.g. voiced, unvoiced, transient, background noise). The goal is to attain the best speech quality at a given average bit rate, also referred to as average data rate (ADR). The codec can operate at different modes by tuning the rate selection module to attain different ADRs at the different modes where the codec performance is improved at increased ADRs. The mode of operation is imposed by the system depending on channel conditions. This enables the codec with a mechanism of trade-off between speech quality and system capacity.

Typically, in VBR coding for CDMA systems, an eighth-rate is used for encoding frames without speech activity (silence or noise-only frames). When the frame is stationary voiced or stationary unvoiced, half-rate or quarter-rate are used depending on the operating mode. If half-rate can be used, a CELP model without the pitch codebook is used in unvoiced case and a signal modification is used to enhance the periodicity and reduce the number of bits for the pitch indices in voiced case. If the operating mode imposes a quarter-rate, no waveform matching is usually possible as the number of bits is insufficient and some parametric coding is generally applied. Full-rate is used for onsets, transient frames, and mixed voiced frames (a typical CELP model is usually used). In addition to the source controlled codec operation in CDMA systems, the system can limit the maximum bit-rate in some speech frames in order to send in-band signalling information (called dim-and-burst signalling) or during bad channel conditions (such as near the cell boundaries) in order to improve the codec robustness. This is referred to as half-rate max. When the rate-selection module chooses the frame to be encoded as a full-rate frame and the system imposes for example HR frame, the speech performance is degraded since the dedicated HR modes are not capable of efficiently encoding onsets and transient signals. Another HR (or quarter-rate (QR)) coding model can be provided to cope with these special cases.

As can be seen from the above description, signal classification and rate determination are very essential for efficient VBR coding. Rate selection is the key part for attaining the lowest average data rate with the best possible quality.

An adaptive multi-rate wideband (AMR-WB) speech codec was recently selected by the ITU-T (International Telecommunications Union—Telecommunication Standardization Sector) for several wideband speech telephony and services and by 3 GPP (third generation partnership project) for GSM and W-CDMA third generation wireless systems. AMR-WB codec consists of nine bit rates, namely 6.6, 8.85, 12.65, 14.25, 15.85, 18.25, 19.85, 23.05, and 23.85 kbit/s. Interoperation between CDMA-WB and AMR-WB codec is thus desirable.

OBJECTS OF THE INVENTION

An object of the present invention is to provide an improved signal classification and rate selection methods for a variable-rate wideband speech coding in general; and in particular to provide an improved signal classification and rate selection methods for a variable-rate multi-mode wideband speech coding suitable for CDMA systems. Another objective is to provide techniques for efficient interoperation between the wideband VBR codec for CDMA systems and the standard AMR-WB codec.

SUMMARY OF THE INVENTION

More specifically, in accordance with a first aspect of the present invention, there is provided a source-controlled Variable bit-rate Multi-mode WideBand (VMR-WB) codec, having a mode of operation that is interoperable with the Adaptive Multi-Rate wideband (AMR-WB) codec, the codec comprising:

at least one Interoperable full-rate (I-FR) coding type; the at least one I-FR coding type having a first bit allocation structure based on an AMR-WB coding types; and at least one comfort noise generator (CNG) coding type for encoding inactive speech frame having a second bit allocation structure based on an AMR-WB SID_UPDATE coding type.

According to a second aspect of the present invention, there is provided a method for digitally encoding a sound using a source-controlled Variable bit rate multi-mode wideband (VMR-WB) codec for interoperation with an adaptative multi-rate wideband (AMR-WB) codec, the method comprising:

providing signal frames from a sampled of the sound;

for each signal frame:

i) determining whether the signal frame is an active speech frame or an inactive speech frame;

ii) if the signal frame is an inactive speech frame then determining whether the speech frame is a SID frame;

iii) if the signal frame is a SID frame, then encoding the signal frame with a quarter-rate (QR) comfort noise generator (CNG) coding algorithm;

iv) if the signal frame is an inactive speech frame that is not a SID frame, then encoding the signal frame with an eighth-rate (ER) CNG coding algorithm; and v) if the signal frame is an active speech frame then encoding the signal frame with an Interoperable coding algorithm using a bit allocation structure based on a AMR-WB codec.

According to a third aspect of the present invention, there is provided a method for translating a Variable bit rate multi-mode wideband (VMR-WB) codec signal frame into an Adaptive Multi-Rate wideband (AMR-WB) signal frame, the method comprising:

i) determining whether the signal frame is one of an Interoperable full-rate (I-FR) frame, an Interoperable half-rate (I-HR) frame, a quarter-rate (QR) comfort noise generator (CNG) frame, and an eighth-rate (ER) comfort noise generator (CNG) frame;

ii) if the signal frame is an I-FR frame then forwarding the signal frame as AMR-WB frame while dropping a first group of frame bits;

iii) if the signal frame is an I-HR frame then forwarding the signal frame as an AMR-WB by generating missing algebraic codebook indices, and by discarding bits indicating the IHR type;

iv) if the signal frame is a quarter-rate (QR) comfort noise generator (CNG) frame then forwarding the signal frame as a SID_UPDATE frames; and v) if the signal frame is an eighth-rate (ER) comfort noise generator (CNG) frame then forwarding the signal frame as a NO_DATA frame.

According to a fourth aspect of the present invention, there is provided a method for translating an Adaptive Multi-Rate wideband (AMR-WB) signal frame into a Variable bit rate multi-mode wideband (VMR-WB) signal frame, the method comprising:

i) determining whether the signal frame is one of a SID_UPDATE frame, SID_FIRST frame, NO_DATA frame, erased frame, and full-rate (FR) frame;

ii) if the signal frame is a SID_UPDATE frame then forwarding the signal frame as a quarter-rate (QR) comfort noise generator (CNG) frame;

iii) if the signal frame is a SID_FIRST or NO_DATA frame then forwarding the signal frame as an eighth-rate (ER) blank frame;

iv) if the signal frame is an erased frame then forwarded the signal frame as a ER erasure frame;

v) if the signal frame is a 12.65, 8.85, or, 6.6 kbit/s frame having a VAD_flag=1 then forwarding the signal frame as an Interoperable full-rate (I-FR) frame;

vi) if the signal frame is a 12.65, 8.85, or, 6.6 kbit/s frame having a VAD_flag=0 then determining whether the signal frame is the first frame after an active speech;

vii) if the signal frame has a VAD_flag=0 and the signal frame is the first frame after an active speech then forwarding the signal frame as an I-FR frame; and viii) if the signal frame has a VAD_flag=0 and the signal frame is not the first frame after an active speech then forwarding the signal frame as an ER blank frame.

Other objects, advantages and features of the present invention will become more apparent upon reading the following non restrictive description of illustrative embodiments thereof, given by way of example only with reference to the accompanying drawings.

DETAILED DESCRIPTION OF THE INVENTION

Figure 1:
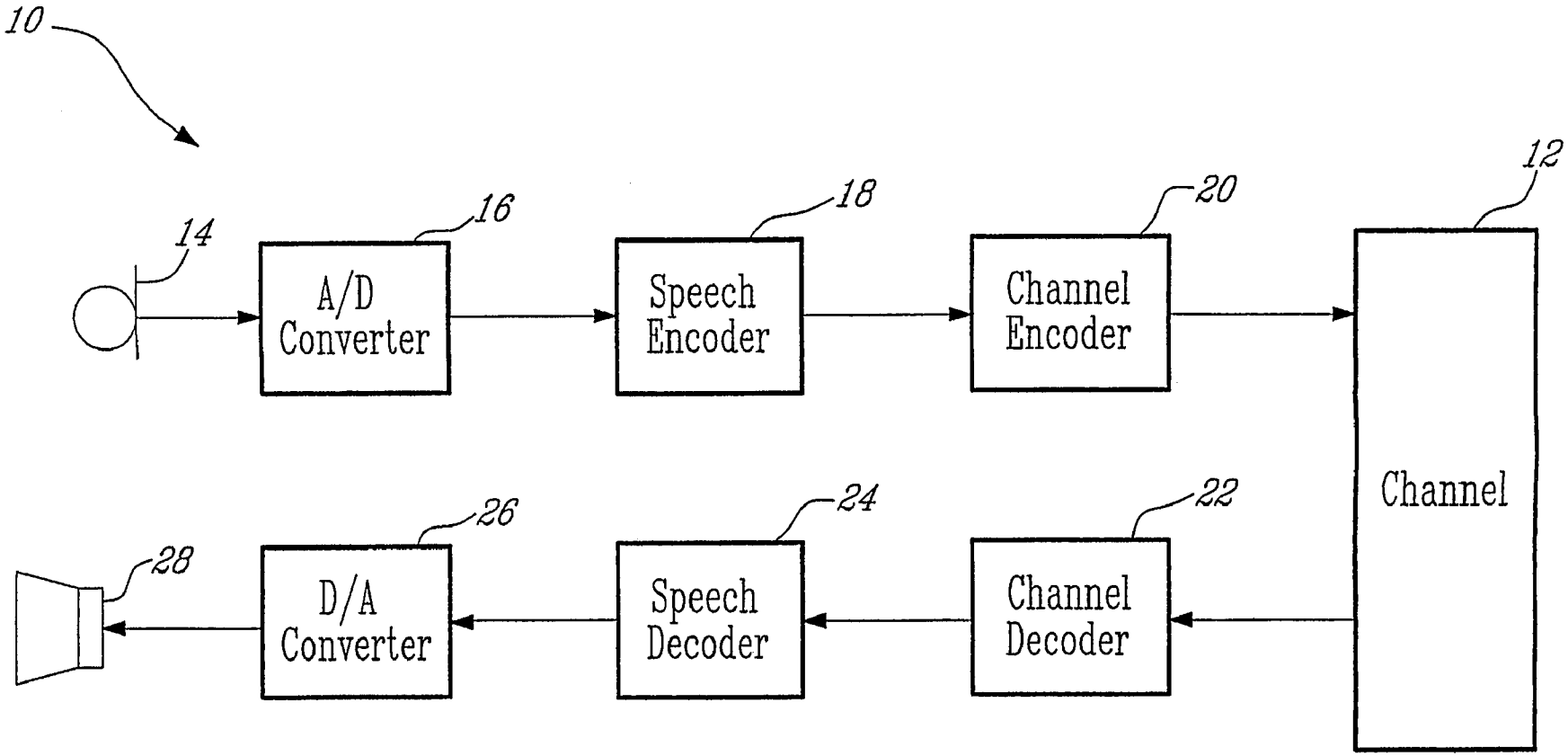
FIG. 1 is a block diagram of a speech communication system illustrating the use of speech encoding and decoding devices in accordance with a first aspect of the present invention.

Turning now to FIG. 1 of the appended drawings, a speech communication system 10 depicting the use of speech encoding and decoding in accordance with an illustrative embodiment of the first aspect of the present invention is illustrated. The speech communication system 10 supports transmission and reproduction of a speech signal across a communication channel 12. The communication channel 12 may comprise for example a wire, optical or fibre link, or a radio frequency link. The communication channel 12 can be also a combination of different transmission media, for example in part fibre link and in part a radio frequency link. The radio frequency link may allow to support multiple, simultaneous speech communications requiring shared bandwidth resources such as may be found in cellular telephony. Alternatively, the communication channel may be replaced by a storage device (not shown) in a single device embodiment of the communication system that records and stores the encoded speech signal for later playback.

The communication system 10 includes an encoder device comprised of a microphone 14, an analog-to-digital converter 16, a speech encoder 18, and a channel encoder 20 on the emitter side of the communication channel 12, and a channel decoder 22, a speech decoder 24, a digital-to-analog converter 26 and a loudspeaker 28 on the receiver side.

The microphone 14 produces an analog speech signal that is conducted to an analog-to-digital (A/D) converter 16 for converting it into a digital form. A speech encoder 18 encodes the digitized speech signal producing a set of parameters that are coded into a binary form and delivered to a channel encoder 20. The optional channel encoder 20 adds redundancy to the binary representation of the coding parameters before transmitting them over the communication channel 12. Also, in some applications such packet-network applications, the encoded frames are packetized before transmission.

In the receiver side, a channel decoder 22 utilizes the redundant information in the received bitstream to detect and correct channel errors occurred in the transmission. A speech decoder 24 converts the bitstream received from the channel decoder 20 back to a set of coding parameters for creating a synthesized speech signal. The synthesized speech signal reconstructed at the speech decoder 24 is converted to an analog form in a digital-to-analog (D/A) converter 26 and played back in a loudspeaker unit 28.

The microphone 14 and/or the A/D converter 16 may be replaced in some embodiments by other speech sources for the speech encoder 18.

The encoder 20 and decoder 22 are configured so as to embody a method for encoding a speech signal according to the present invention as described hereinbelow.

Signal Classification

Figure 2:
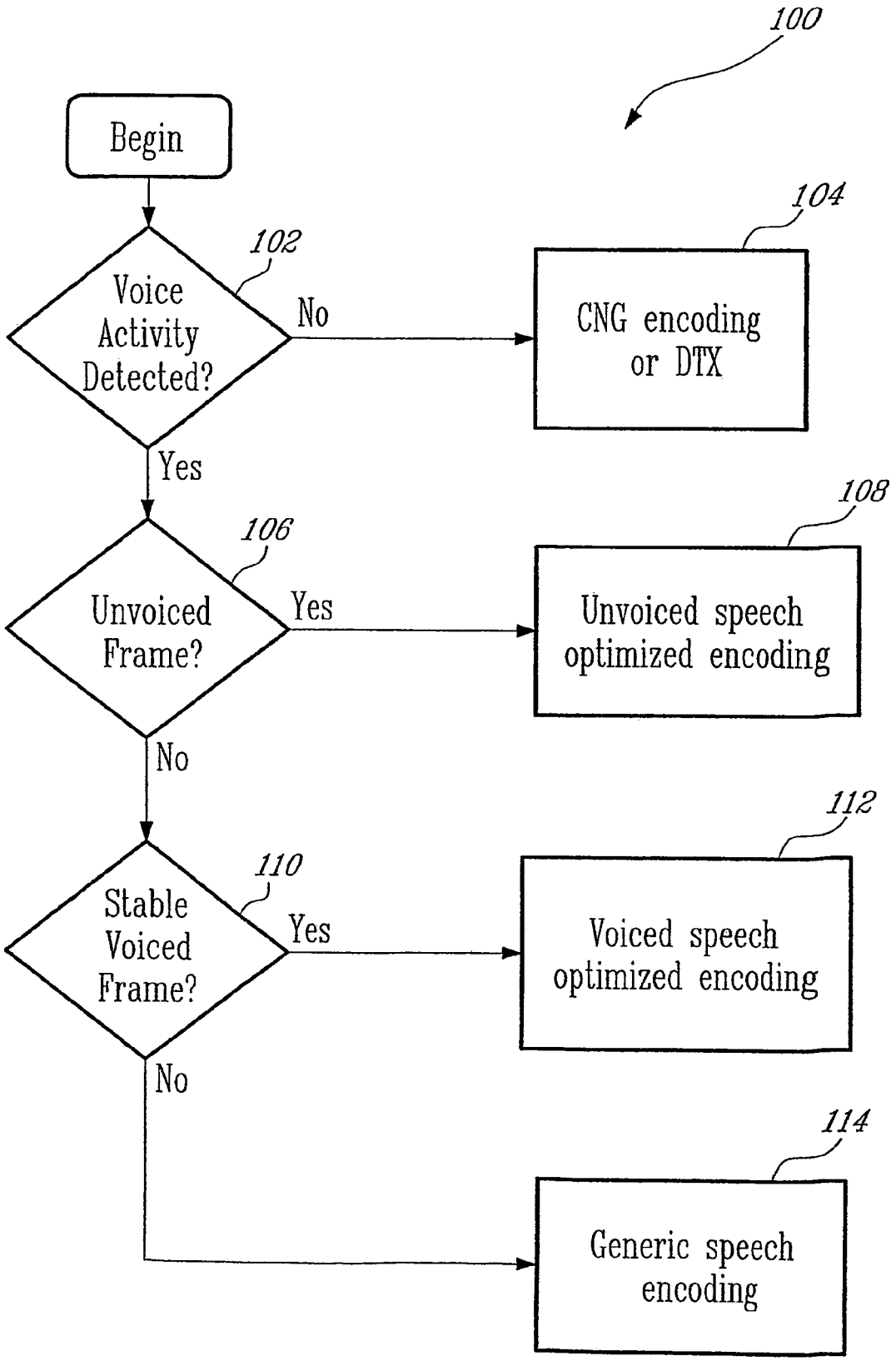
FIG. 2 is a flowchart illustrating a method for digitally encoding a sound signal according to a first illustrative embodiment of a second aspect of the present invention.

Turning now to FIG. 2, a method 100 for digitally encoding a speech signal according to a first illustrative embodiment of a first aspect of the present invention is illustrated. The method 100 includes a speech signal classification method according to an illustrative embodiment of a second aspect of the present invention. It is to be noted that the expression speech signal refers to voice signals as well as any multimedia signal that may include a voice portion such as audio with speech content (speech in between music, speech with background music, speech with special sound effects, etc.)

As illustrated in FIG. 2, the signal classification is done in three steps 102, 106 and 110, each of them discriminating a specific signal class. First, in step 102, a first-level classifier in the form of a voice activity detector (VAD) (not shown) discriminates between active and inactive speech frames. If an inactive speech frame is detected then the encoding method 100 ends with the encoding of the current frame with, for example, comfort noise generation (CNG) (step 104). If an active speech frame is detected in step 102, the frame is subjected to a second level classifier (not shown) configured to discriminate unvoiced frames. In step 106, if the classifier classifies the frame as unvoiced speech signal, the encoding method 100 ends in step 108, where the frame is encoded using a coding technique optimized for unvoiced signals. Otherwise, the speech frame is passed in step 110, through a third-level classifier (not shown) in the form of a "stable voiced" classification module (not shown). If the current frame is classified as a stable voiced frame, then the frame is encoded using a coding technique optimized for stable voiced signals (step 112). Otherwise, the frame is likely to contain a non-stationary speech segment such as a voiced onset or rapidly evolving voiced speech signal portion, and the frame is encoded using a general purpose speech coder with high bit rate allowing to sustain good subjective quality (step 114). Note that if the relative energy of the frame is lower than a certain threshold then these frames can be encoded with a generic lower rate coding type to further reduce the average data rate.

The classifiers and encoders may take many forms from an electronic circuitry to a chip processor.

In the following, the classification of different types of speech signal will be explained in more details, and methods for classification of unvoiced and voiced speech will be disclosed.

Discrimination of Inactive Speech Frames (VAD)

The inactive speech frames are discriminated in step 102 using a Voice Activity Detector (VAD). The VAD design is well-known to a person skilled in the art and will not be described herein in more detail. An example of VAD is described in M. Jelinek and F. Labonté, "Robust Signal/Noise Discrimination for Wideband Speech and Audio Coding," Proc. *IEEE Workshop on Speech Coding*, pp. 151–153, Delavan, Wis., USA, September 2000.

Discrimination of Unvoiced Active Speech Frames

The unvoiced parts of a speech signal are characterized by missing periodicity and can be further divided into unstable frames, where the energy and the spectrum changes rapidly, and stable frames where these characteristics remain relatively stable.

In step 106, unvoiced frames are discriminated using at least three out of the following parameters:

A voicing measure, which may be computed as an averaged normalized correlation ($\bar{r}_x$);

a spectral tilt measure ($e_t$);

a signal energy ratio (dE) used to assess the frame energy variation within the frame and thus the frame stability; and the relative energy of the frame.

Voicing Measure

Figure 3:
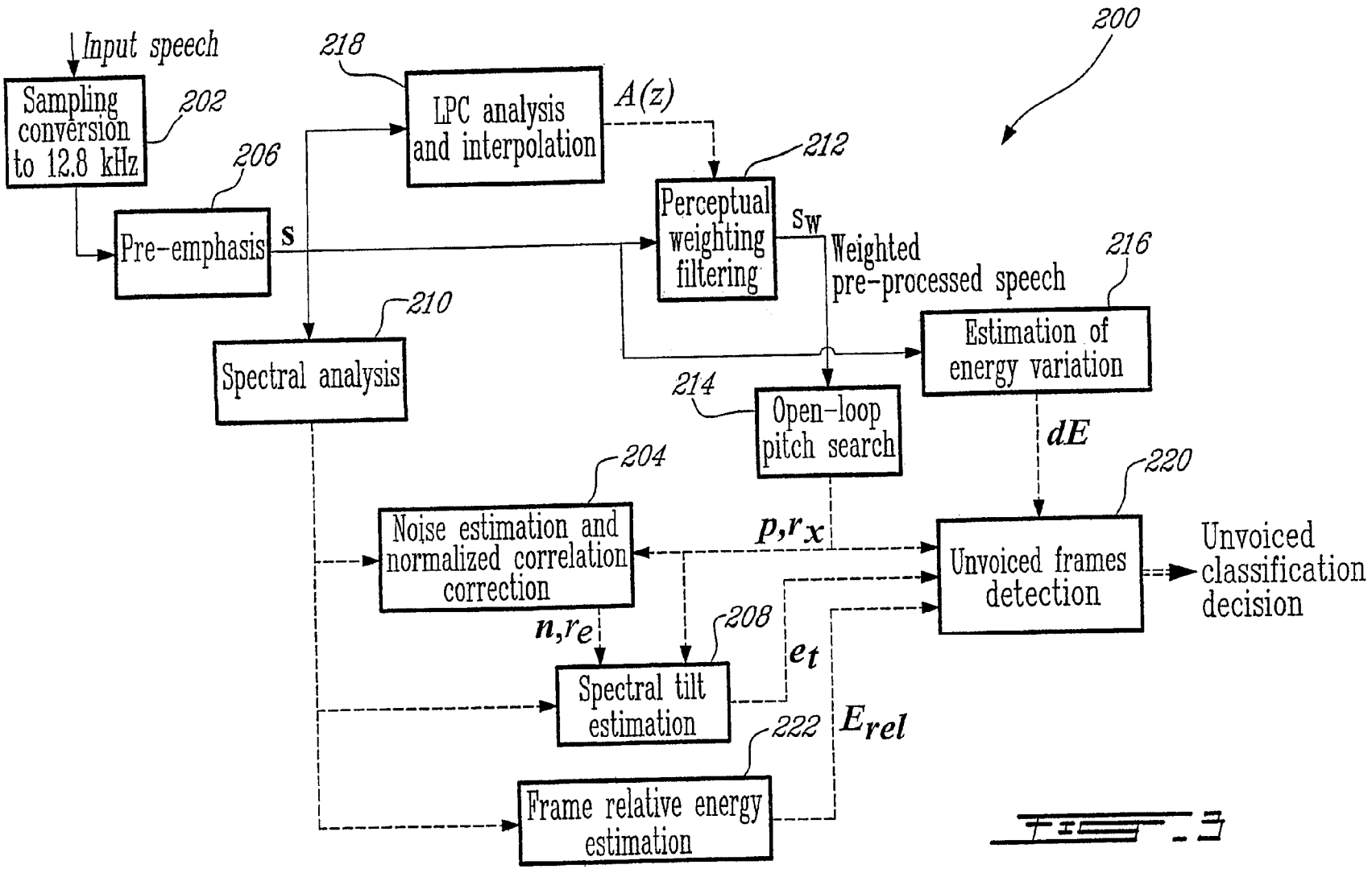
FIG. 3 is a flowchart illustrating a method for discriminating unvoiced frame according to an illustrative embodiment of a third aspect of the present invention.

FIG. 3 illustrates a method 200 for discriminating unvoiced frame according to an illustrative embodiment of a third aspect of the present invention.

The normalized correlation, used to determine the voicing measure, is computed as part of the open-loop pitch search module 214. In the illustrative embodiment of FIG. 3, 20 ms frames are used. The open-loop pitch search module usually outputs the open-loop pitch estimate p every 10 ms (twice per frame). In the method 200, it is also used to output the normalized correlation measures $r_x$. These normalized correlations are computed on the weighted speech and the past weighted speech at the open-loop pitch delay. The weighted speech signal $s_w(n)$ is computed in a perceptual weighting filter 212. In this illustrative embodiment, a perceptual weighting filter 212 with fixed denominator, suited for wideband signals, is used. The following relation gives an example of transfer function for the perceptual weighting filter 212:

$$W(z)=A(z/\gamma_1)/(1-\gamma_2 z^{-1}) \text{ where } 0<\gamma_2<\gamma_1\leqq 1$$

where A(z) is the transfer function of the linear prediction (LP) filter computed in module 218, which is given by the following relation:

$$A(z) = 1 + \sum_{i=1}^{p} a_i z^{-i}$$

The voicing measure is given by the average correlation $\bar{r}_x$ which is defined as $$\bar{r}_x = \frac{1}{3}(r_x(0) + r_x(1) + r_x(2)) \tag{1}$$

where $r_x(0)$, $r_x(1)$ and $r_x(2)$ are respectively the normalized correlation of the first half of the current frame, the normalized correlation of the second half of the current frame, and the normalized correlation of the look-ahead (beginning of next frame).

A noise correction factor $r_e$ can be added to the normalized correlation in Equation (1) to account for the presence of background noise. In the presence of background noise, the average normalized correlation decreases. However, for the purpose of signal classification, this decrease should not affect the voiced-unvoiced decision, so this is compensated by the addition of $r_e$. It should be noted that when a good noise reduction algorithm is used $r_e$ is practically zero. In the method 200, a look-ahead of 13 ms is used. The normalized correlation $r_x(k)$ is computed as follows $$r_x(k) = \frac{r_{xy}}{\sqrt{r_{xx} \cdot r_{yy}}}, \text{ where} \tag{2}$$

$$r_{xy} = \sum_{i=0}^{L_k-1} x(t_k + i) \cdot x(t_k + i - p_k)$$

$$r_{xx} = \sum_{i=0}^{L_k-1} x^2(t_k + i)$$

$$r_{yy} = \sum_{i=0}^{L_k-1} x^2(t_k + i - p_k)$$

In the method 200, the computation of the correlations is as follows. The correlations $r_x(k)$ are computed on the weighted speech signal $s_w(n)$. The instants $t_k$ are related to the current half-frame beginning and are equal to 0, 128 and 256 samples respectively for k=0, 1 and 2, at 12800 Hz sampling rate. The values $p_k=T_{OL}$ are the selected open-loop pitch estimates for the half-frames. The length of the autocorrelation computation $L_k$ is dependent on the pitch period. In a first embodiment, the values of $L_k$ are summarized below (for the 12.8 kHz sampling rate):

$L_k$=80 samples for $p_k \leqq 62$ samples $L_k$=124 samples for $62<p_k \leqq 122$ samples $L_k$=230 samples for $p_k>122$ samples These lengths assure that the correlated vector length comprises at least one pitch period, which helps for a robust open loop pitch detection. For long pitch periods ($p_1>122$ samples), $r_x(1)$ and $r_x(2)$ are identical, i.e. only one correlation is computed since the correlated vectors are long enough that the analysis on the look ahead is no longer necessary.

Alternatively, the weighted speech signal can be decimated by 2 to simplify the open loop pitch search. The weighted speech signal can be low-pass filtered before decimation. In this case, the values of $L_k$ are given by $L_k$=40 samples for $p_k \leqq 31$ samples $L_k$=62 samples for $62<p_k \leqq 61$ samples $L_k$=115 samples for $p_k>61$ samples Other methods can be used to compute the correlations. For example, only one normalized correlation value can be computed for the whole frame instead of averaging several normalized correlations. Further, the correlations can be computed on signals other than the weighted speech such as the residual signal, the speech signal, or a low-pass filtered residual, speech, or weighted speech signal.

Spectral Tilt

The spectral tilt parameter contains the information about the frequency distribution of energy. In method 200, the spectral tilt is estimated in the frequency domain as a ratio between the energy concentrated in low frequencies and the energy concentrated in high frequencies. However, it can be also estimated in different ways such as a ratio between the two first autocorrelation coefficients of the speech signal.

Figure 10:
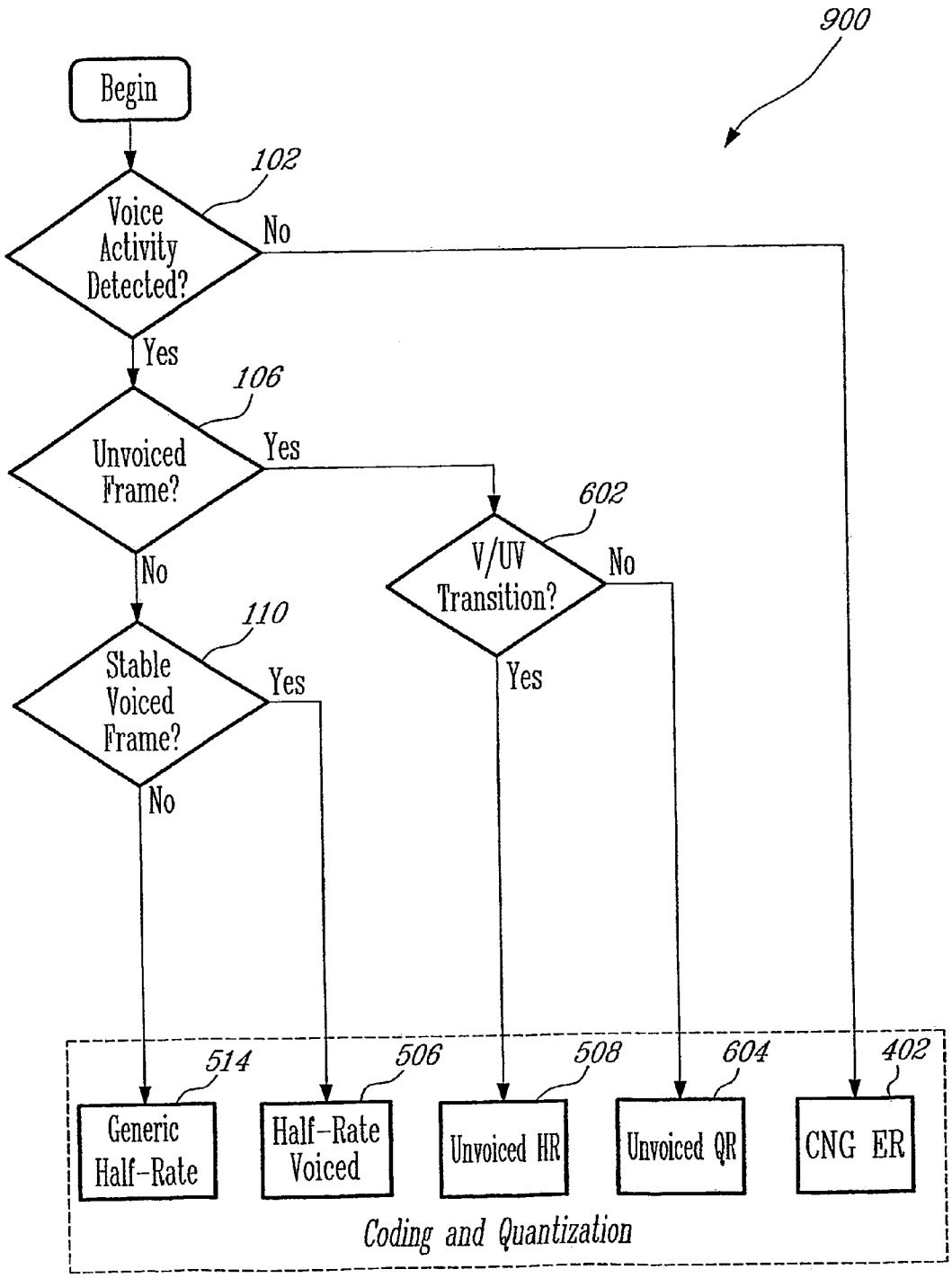
FIG. 10 is a flowchart illustrating a method for digitally encoding a sound signal in the Economy mode during half-rate max according to a seventh illustrative embodiment of the second aspect of the present invention.

In the method 200, the discrete Fourier Transform is used to perform the spectral analysis in module 210 of FIG. 10. The frequency analysis and the tilt computation are done twice per frame. 256 points Fast Fourier Transform (FFT) is used with 50 percent overlap. The analysis windows are placed so that the entire lookahead is exploited. The beginning of the first window is placed 24 samples after the beginning of the current frame. The second window is placed 128 samples further. Different windows can be used to weight the input signal for the frequency analysis. A square root of a Hamming window (which is equivalent to a sine window) is used. This window is particularly well suited for overlap-add methods, therefore this particular spectral analysis can be used in an optional noise suppression algorithm based on spectral subtraction and overlap-add analysis/synthesis. Since noise suppression algorithms are believed to be well-known in the art, it will not be described herein in more detail.

The energy in high frequencies and in low frequencies is computed following the perceptual critical bands (see J. D. Johnston, "Transform Coding of Audio Signals Using Perceptual Noise Criteria," *IEEE Jour. on Selected Areas in Communications,* vol. 6, no. 2, pp. 314–323):

Critical bands={100.0, 200.0, 300.0, 400.0, 510.0, 630.0, 770.0, 920.0, 1080.0, 1270.0, 1480.0, 1720.0, 2000.0, 2320.0, 2700.0, 3150.0, 3700.0, 4400.0, 5300.0, 6350.0} Hz.

The energy in high frequencies is computed as the average of the energies of the last two critical bands $$\overline{E}_h=0.5(E_{CB}(18)+E_{CB}(19))$$

where $E_{CB}(i)$ are the average energies per critical band computed as $$E_{CB}(i)=\frac{1}{N_{CB}(i)}\sum_{k=0}^{N_{CB}(i)-1}(X_R^2(k+j_i)+X_I^2(k+j_i)),\quad i=0,\ldots,19$$

where $N_{CB}(i)$ is the number of frequency bins in the ith band and $X_R(k)$ and $X_I(k)$ are, respectively, the real and imaginary parts of the kth frequency bin and $j_i$ is the index of the first bin in the ith critical band.

The energy in low frequencies is computed as the average of the energies in the first 10 critical bands. The middle critical bands have been excluded from the computation to improve the discrimination between frames with high-energy concentration in low frequencies (generally voiced) and with high-energy concentration in high frequencies (generally unvoiced). In between, the energy content is not characteristic for any of the classes and increases the decision confusion.

The energy in low frequencies is computed differently for long pitch periods and short pitch periods. For voiced female speech segments, the harmonic structure of the spectrum is exploited to increase the voiced-unvoiced discrimination. Thus for short pitch periods, $E_l$ is computed bin-wise and only frequency bins sufficiently close to the speech harmonics are taken into account in the summation. That is $$\overline{E}_l=\frac{1}{cnt}\sum_{k=0}^{24}E_{BIN}(k)w_h(k)$$

where $E_{BIN}(k)$ are the bin energies in the first 25 frequency bins (the DC component is not considered). Note that these 25 bins correspond to the first 10 critical bands. In the summation above, only terms related to the bins close to the pitch harmonics are considered, so $w_h(k)$ is set to 1 if the distance between the bin and the nearest harmonic is not larger than a certain frequency threshold (50 Hz) and is set to 0 otherwise. The counter cnt is the number of the non-zero terms in the summation. Only bins closer than 50 Hz to the nearest harmonics are taken into account. Hence, if the structure is harmonic in low frequencies, only high-energy terms will be included in the sum. On the other hand, if the structure is not harmonic, the selection of the terms will be random and the sum will be smaller. Thus even unvoiced sounds with high energy content in low frequencies can be detected. This processing cannot be done for longer pitch periods, as the frequency resolution is not sufficient. For pitch values larger than 128 or for a priori unvoiced sounds the low frequency energy is computed per critical band as $$\overline{E}_l=\frac{1}{10}\sum_{k=0}^{9}E_{CB}(k)$$

A priori unvoiced sounds are determined when $r_x(0)+r_x(1)+r_e<0.6$, where the value $r_e$ is a correction added to the normalized correlation as described above.

The resulting low and high frequency energies are obtained by subtracting estimated noise energy from the values $\overline{E}_l$ and $\overline{E}_h$ calculated above. That is $$E_h=\overline{E}_h-N_h$$

$$E_l=\overline{E}_l-N_l$$

where $N_h$ and $N_l$ are the averaged noise energies in the last 2 critical bands and first 10 critical bands respectively. The estimated noise energies have been added to the tilt computation to account for the presence of background noise.

Finally, the spectral tilt is given by $$e_{tilt}(i)=\frac{E_l}{E_h}$$

Note that the spectral tilt computation is performed twice per frame to obtain $e_{tilt}(0)$ and $e_{tilt}(1)$ corresponding to both spectral analysis per frame. The average spectral tilt used in unvoiced frame classification is given by $$e_t=\frac{1}{3}(e_{old}+e_{tilt}(0)+e_{tilt}(1))$$

where $e_{old}$ is the tilt from the second spectral analysis of the previous frame.

Energy Variation dE

The energy variation dE is evaluated on the denoised speech signal s(n), where n=0 corresponds to the current frame beginning. The signal energy is evaluated twice per subframe, i.e. 8 times per frame, based on short-time segments of length 32 samples. Further, the short-term energies of the last 32 samples from the previous frame and the first 32 samples from next frame are also computed. The short-time maximum energies are computed as $$E_{st}^{(1)}(j)=\max_{i=0}^{31}(s^2(i+32j)),\quad j=-1,\ldots,8,$$

where j=−1 and j=8 correspond to the end of previous frame and the beginning of next frame. Another set of 9 maximum energies is computed by shifting the speech indices by 16 samples. That is $$E_{st}^{(2)}(j) = \max_{i=0}^{31}(s^2(i+32j-16)),\ j=0,\ldots,8.$$

The maximum energy variation dE between consecutive short term segments is computed as the maximum of the following:

$$E_{st}^{(1)}(0)/E_{st}^{(1)}(-1) \text{ if } E_{st}^{(1)}(0)>E_{st}(-1),$$

$$E_{st}^{(1)}(7)/E_{st}^{(1)}(8) \text{ if } E_{st}^{(1)}(7)>E_{st}(8),$$

$$\frac{\max(E_{st}^{(1)}(j),\ E_{st}^{(1)}(j-1))}{\min(E_{st}^{(1)}(j),\ E_{st}^{(1)}(j-1))} \text{for } j=1 \text{ to } 7$$

$$\frac{\max(E_{st}^{(2)}(j),\ E_{st}^{(2)}(j-1))}{\min(E_{st}^{(2)}(j),\ E_{st}^{(2)}(j-1))} \text{for } j=1 \text{ to } 8$$

Alternatively, other methods can be used to evaluate the energy variation in the frame.

Relative Energy $E_{rel}$

The relative energy of the frame is given by the difference between the frame energy in dB and the long-term average energy. The frame energy is computed as $$E_t = 10\log\left(\sum_{i=0}^{19} E_{CB}(i)\right),\ \text{dB}$$

where $E_{CB}(i)$ are the average energies per critical band as described above. The long-term average frame energy is given by $$\overline{E}_f = 0.99\overline{E}_f + 0.01E_t$$

with initial value $\overline{E}_f$=45 dB.

Thus the relative frame energy is given by $$E_{rel} = E_t - E_f$$

The relative frame energy is used to identify low energy frames that have not been classified as background noise frames or unvoiced frames. These frames can be encoded with a generic HR encoder in order to reduce the ADR.

Unvoiced Speech Classification

The classification of unvoiced speech frames is based on the parameters described above, namely: the voicing measure $\bar{r}_x$, the spectral tilt $e_t$, the energy variation within a frame dE, and the relative frame energy $E_{rel}$. The decision is made based on at least three of these parameters. The decision thresholds are set based on the operating mode (the required average data rate). Basically for operating modes with lower desired data rates, the thresholds are set to favor more unvoiced classification (since a half-rate or a quarter rate coding will be used to encode the frame). Unvoiced frames are usually encoded with unvoiced HR encoder. However, in case of the economy mode, unvoiced QR may also be used in order to further reduce the ADR if additional certain conditions are satisfied.

In Premium mode, the frame is encoded as unvoiced HR if the following condition is satisfied $$(\bar{r}_x < th_1) \text{ AND } (e_t < th_2) \text{ AND } (\text{dE} < th_3)$$

where $th_1$=0.5, $th_2$=1, and $$th_3 = \begin{cases} -4 & \text{for} \quad \overline{E}_f > 34 \\ 0 & \text{for} \quad 21 < \overline{E}_f < 34 \\ 4 & \text{otherwise} \end{cases}$$

In voice activity decision, a decision hangover is used. Thus, after active speech periods, when the algorithm decides that the frame is an inactive speech frame, a local VAD is set to zero but the actual VAD flag is set to zero only after a certain number of frames are elapsed (the hangover period). This avoids clipping of speech offsets. In both the Standard and Economy modes, if the local VAD is zero, the frame is classified as an unvoiced frame.

In the Standard mode, the frame is encoded as unvoiced HR if local VAD=0 or if the following condition is satisfied:

$$(\bar{r}_x < th_4) \text{ AND } (e_t < th_5) \text{ AND } ((\text{dE} < th_6) \text{ OR } (E_{rel} < th_7))$$

where $th_4$=0.695, $th_5$=4, $th_6$=40, and $th_7$=−14.

In Economy mode, the frame is declared as an unvoiced frame if local VAD=0 OR if the following condition is satisfied:

$$(\bar{r}_x < th_8) \text{ AND } (e_t < th_9) \text{ AND } ((\text{dE} < th_{10}) \text{ OR } (E_{rel} < th_{11}))$$

where $th_8$=0.695, $th_9$=4, $th_{10}$=60, and $th_{11}$=−14.

In Economy mode, unvoiced frames are usually encoded as unvoiced HR. However, they can also be encoded with unvoiced QR if the following further conditions are also satisfied: If the last frame is either unvoiced of background noise frame, and if at the end of the frame the energy is concentrated in high frequencies and no potential voiced onset is detected in the lookahead then the frame is encoded as unvoiced QR. The last two conditions are detected as:

$$(r_x(2) < th_{12}) \text{ AND } (e_{tilt}(1) < th_{13})$$

where $th_{12}$=0.73, $th_{13}$

Note that $r_x(2)$ is the normalized correlation in the lookahead and $e_{tilt}(1)$ is the tilt in the second spectral analysis which spans the end of the frame and the lookahead.

Of course, other methods than method 200 can be used for discriminating unvoiced frame.

Discrimination of Stable Voiced Speech Frames

In case of Standard and Economy modes, stable voiced frames can be encoded using Voiced HR coding type.

The Voiced HR coding type makes use of signal modification for efficiently encoding stable voiced frames.

Signal modification techniques adjust the pitch of the signal to a predetermined delay contour. Long term prediction then maps the past excitation signal to the present subframe using this delay contour and scaling by a gain parameter. The delay contour is obtained straightforwardly by interpolating between two open-loop pitch estimates, the first obtained in the previous frame and the second in the current frame. Interpolation gives a delay value for every time instant of the frame. After the delay contour is available, the pitch in the subframe to be coded currently is adjusted to follow this artificial contour by warping, changing the time scale of the signal. In discontinuous warping [1, 4, 5], a signal segment is shifted either to the left or to the right without altering the segment length. Discontinuous warping requires a procedure for handling the resulting overlapping or missing signal portions. For reducing artifacts in these operations, the tolerated change in the time scale is kept small. Moreover, warping is typically done using the LP residual signal or the weighted speech signal to reduce the resulting distortions. The use of these signals instead of the speech signal also facilitates detection of pitch pulses and low-power regions in between them, and thus the determination of the signal segments for warping. The actual modified speech signal is generated by inverse filtering.

After the signal modification is done for the present subframe, the coding can proceed in conventional manner except the adaptive codebook excitation is generated using the predetermined delay contour.

In the present illustrative embodiment, signal modification is done pitch and frame synchronously, that is, adapting one pitch cycle segment at a time in the current frame such that a subsequent speech frame starts in perfect time alignment with the original signal. The pitch cycle segments are limited by frame boundaries. This prevents time shift translating over frame boundaries simplifying encoder implementation and reducing a risk of artifacts in the modified speech signal. This also simplifies variable bit rate operation between signal modification enabled and disabled coding types, since every new frame starts in time alignment with the original signal.

As illustrated in FIG. 2, if a frame is not classified as inactive speech frame nor as unvoiced frame then it is tested if it is a stable voiced frame (step 110). Classification of stable voiced frames is performed using a closed-loop approach in conjunction with the signal modification procedure used for encoding stable voiced frames.

Figure 4:
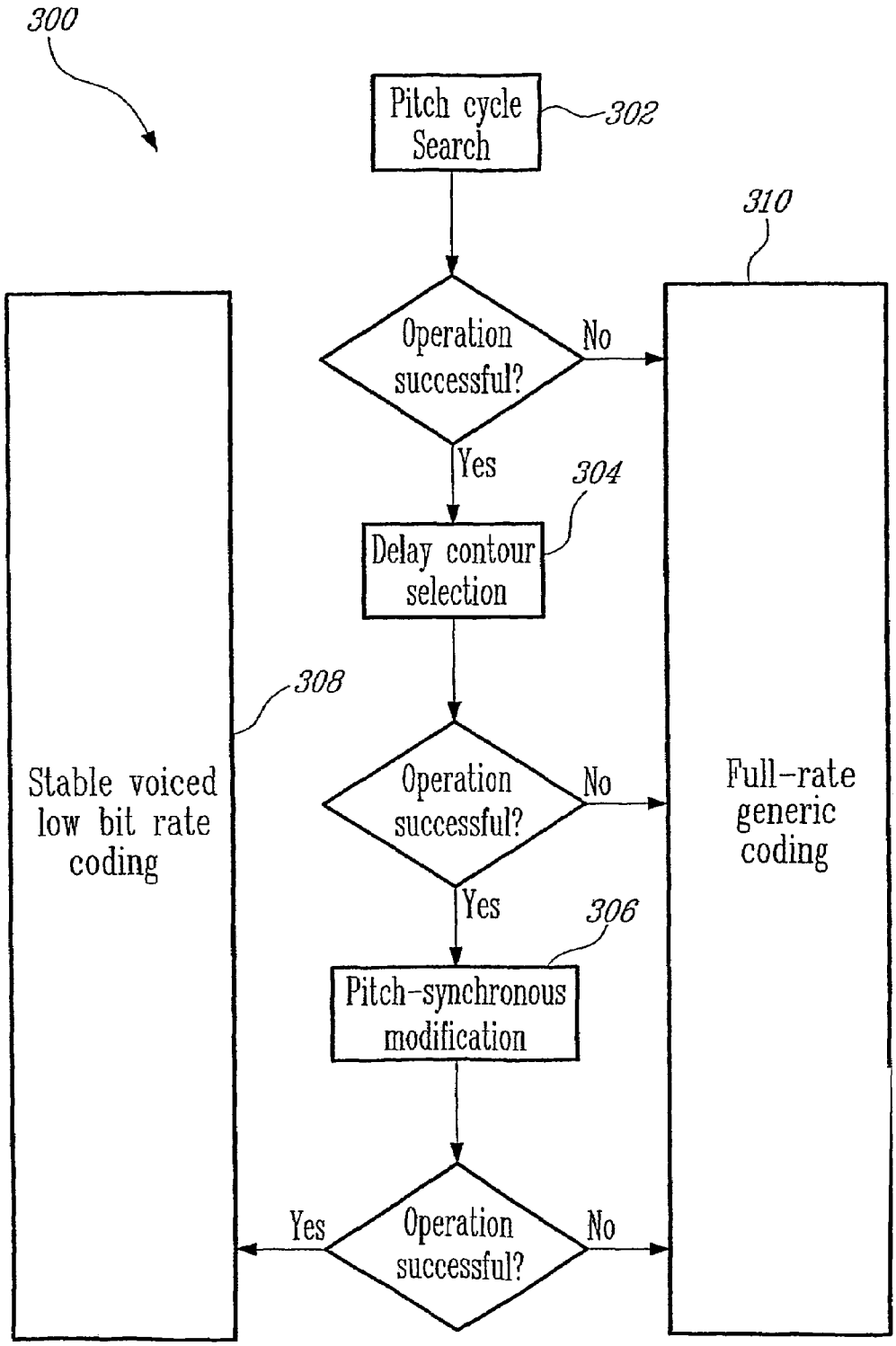
FIG. 4 is a flowchart illustrating a method for discriminating stable voiced frame according to an illustrative embodiment of a fourth aspect of the present invention.

FIG. 4 illustrates a method 300 for discriminating stable voiced frame according to an illustrative embodiment of a fourth aspect of the present invention.

The sub-procedures in the signal modification yields indicators quantifying the attainable performance of long term prediction in the current frame. If any of these indicators is outside its allowed limits, the signal modification procedure is terminated by one of the logic blocks. In this case, the original signal is preserved intact, and the frame is not classified as stable voiced frame. This integrated logic allows maximizing the quality of the modified speech signal after signal modification and coding at a low bit rate.

The pitch pulse search procedure of step 302 produces several indicators on the periodicity of the current frame. Hence the logic block following it is an important component of the classification logic. The evolution of the pitch-cycle length is observed. The logic block compares the distance of the detected pitch pulse positions against the interpolated open-loop pitch estimate as well as against the distance of previously detected pitch pulses. The signal modification procedure is terminated if the difference to the open-loop pitch estimate or to the previous pitch cycle lengths is too large.

The selection of the delay contour in step 304 gives additional information on the evolution of the pitch cycles and the periodicity of the current speech frame. The signal modification procedure is continued from this block if the condition $|d_n - d_{n-1}| < 0.2 d_n$ is fulfilled, where $d_n$ and $d_{n-1}$ are the pitch delays in the present and past frames. This essentially means that only a small delay change is tolerated for classifying the present frame as stable voiced.

When the frames subjected to the signal modification are coded at a low bit rate, the shape of pitch cycle segments is kept similar over the frame to allow faithful signal modeling by long-term prediction and thus coding at a low bit rate without degrading the subjective quality. In the signal modification step 306, the similarity of successive segments can be quantified by the normalized correlation between the current segment and the target signal at the optimal shift. Shifting of the pitch cycle segments maximizing their correlation with the target signal enhances the periodicity and yields a high long-term prediction gain if the signal modification is useful. The success of the procedure is guaranteed by requiring that all the correlation values must be larger than a predefined threshold. If this condition is not fulfilled for all segments, the signal modification procedure is terminated and the original signal is kept intact. In general, a slightly lower gain threshold range can be allowed on male voices with equal coding performance. Gain thresholds can be changed in different operating modes of the VBR codec to adjust the usage of the coding modes that apply the signal modification and thus change the targeted average bit rate.

As described hereinabove, the complete rate selection logic according to the method 100 comprises three steps, each of them discriminating a specific signal class. One of the steps includes the signal modification algorithm as its integral part. First, a VAD discriminates between active and inactive speech frames. If an inactive speech frame is detected, the classification method ends as the frame is regarded as background noise and encoded, for example, with a comfort noise generator. If an active speech frame is detected, the frame is subjected to the second step dedicated to discriminate unvoiced frames. If the frame is classified as unvoiced speech signal, the classification chain ends, and the frame is encoded with a mode dedicated for unvoiced frames. As the last step, the speech frame is processed through the proposed signal modification procedure that enables the modification if the conditions described earlier in this subsection are verified. In this case, the frame is classified as stable voiced frame, the pitch of the original signal is adjusted to an artificial, well-defined delay contour, and the frame is encoded using a specific mode optimized for these types of frames. Otherwise, the frame is likely to contain a non-stationary speech segment such as a voiced onset or rapidly evolving voiced speech signal. These frames typically require a more generic coding model. These frames are usually encoded with a Generic FR coding type. However, if the relative energy of the frame is lower than a certain threshold then these frames can be encoded with a Generic HR coding type to further reduce the ADR.

Speech Coding and Rate Selection for CDMA Multi-Mode VBR Systems

Methods for rate selection and digital encoding of a sound for CDMA multi-mode VBR systems that can operate in Rate Set II will now be described according to illustrated embodiments of the present invention.

The described codec is based on the adaptive multi-rate wideband (AMR-WB) speech codec that was recently selected by the ITU-T (International Telecommunications Union—Telecommunication Standardization Sector) for several wideband speech services and by 3 GPP (third generation partnership project) for GSM and W-CDMA third generation wireless systems. AMR-WB codec consists of nine bit rates, namely 6.6, 8.85, 12.65, 14.25, 15.85, 18.25, 19.85, 23.05, and 23.85 kbit/s. An AMR-WB-based source controlled VBR codec for CDMA system allows enabling the interoperation between CDMA and other systems using the AMR-WB codec. The AMR-WB bit rate of 12.65 kbit/s, which is the closest rate that can fit in the 13.3 kbit/s full-rate of Rate Set II can be used as the common rate between a CDMA wideband VBR codec and AMR-WB which will enable the interoperability without the need for transcoding (which degrades the speech quality). Lower rate coding types are provided specifically for the CDMA VBR wideband solution to enable the efficient operation in the Rate Set II framework. The codec then can operate in few CDMA-specific modes using all rates but it will have a mode that enables interoperability with systems using the AMR-WB codec.

The coding methods according to embodiments of the present invention are summarized in Table 1 and will be generally referred to as coding types.

TABLE 1

Coding types used in the illustrative embodiments with corresponding bit rates.

| Coding Type | Bit Rate [kbit/s] | Bits/20 ms frame |
|---|---|---|
| Generic FR | 13.3 | 266 |
| Interoperable FR | 13.3 | 266 |
| Voiced HR | 6.2 | 124 |
| Unvoiced HR | 6.2 | 124 |
| Interoperable HR | 6.2 | 124 |
| Generic HR | 6.2 | 124 |
| Unvoiced QR | 2.7 | 54 |
| CNG QR | 2.7 | 54 |
| CNG ER | 1.0 | 20 |

The full-rate (FR) coding types are based on the AMR-WB standard codec at 12.65 kbit/s. The use of the 12.65 kbit/s rate of the AMR-WB codec enables the design of a variable bit rate codec for the CDMA system capable of interoperating with other systems using the AMR-WB codec standard. Extra 13 bits per frame are added to fit in the 13.3 kbit/s full-rate of CDMA Rate Set II. These bits are used to improve the codec robustness in case of erased frames and make essentially the difference between Generic FR and Interoperable FR coding types (they are unused in the Interoperable FR). The FR coding types are based on the algebraic code-excited linear prediction (ACELP) model optimized for general wideband speech signals. It operates on 20 ms speech frames with a sampling frequency of 16 kHz. Before further processing, the input signal is down-sampled to 12.8 kHz sampling frequency and pre-processed. The LP filter parameters are encoded once per frame using 46 bits. Then the frame is divided into four subframes where adaptive and fixed codebook indices and gains are encoded once per subframe. The fixed codebook is constructed using an algebraic codebook structure where the 64 positions in a subframe are divided into 4 tracks of interleaved positions and where 2 signed pulses are placed in each track. The two pulses per track are encoded using 9 bits giving a total of 36 bits per subframe. More details about the AMR-WB codec can be found in ITU-T Recommendation G.722.2 "Wideband coding of speech at around 16 kbit/s using Adaptive Multi-Rate Wideband (AMR-WB)", Geneva, 2002. The bit allocations for the FR coding types are given in Table 2.

TABLE 2

Bit allocation of Generic and Interoperable full-rate CDMA2000 Rate Set II based on the AMR-WB standard at 12.65 kbit/s.

| Parameter | Bits per Frame: Generic FR | Bits per Frame: Interoperable FR |
|---|---|---|
| Class Info | — | — |
| VAD bit | — | 1 |
| LP Parameters | 46 | 46 |
| Pitch Delay | 30 | 30 |
| Pitch Filtering | 4 | 4 |
| Gains | 28 | 28 |
| Algebraic Codebook | 144 | 144 |
| FER protection bits | 14 | — |
| Unused bits | — | 13 |
| Total | 266 | 266 |

In case of stable voiced frames, the Half-Rate Voiced coding is used. The half-rate voiced bit allocation is given in Table 3. Since the frames to be coded in this communication mode are characteristically very periodic, a substantially lower bit rate suffices for sustaining good subjective quality compared for instance to transition frames. Signal modification is used which allows efficient coding of the delay information using only nine bits per 20-ms frame saving a considerable proportion of the bit budget for other signal-coding parameters. In signal modification, the signal is forced to follow a certain pitch contour that can be transmitted with 9 bits per frame. Good performance of long-term prediction allows using only 12 bits per 5-ms subframe for the fixed-codebook excitation without sacrificing the subjective speech quality. The fixed-codebook is an algebraic codebook and comprises two tracks with one pulse each, whereas each track has 32 possible positions.

TABLE 3

Bit allocation of half-rate Generic, Voiced, Unvoiced according to CDMA2000 Rate Set II.

| Parameter | Bits per frame: Generic HR | Voiced HR | Unvoiced HR | Interoperable HR |
|---|---|---|---|---|
| Class Info | 1 | 3 | 2 | 3 |
| VAD bit | — | — | — | 1 |
| LP Parameters | 36 | 36 | 46 | 46 |
| Pitch Delay | 13 | 9 | — | 30 |
| Pitch Filtering | — | 2 | — | 4 |
| Gains | 26 | 26 | 24 | 28 |
| Algebraic Codebook | 48 | 48 | 52 | — |
| FER protection bits | — | — | — | — |
| Unused bits | — | — | — | 12 |
| Total | 124 | 124 | 124 | 124 |

In case of unvoiced frames, the adaptive codebook (or pitch codebook) is not used. A 13-bit Gaussian codebook is used in each subframe where the codebook gain is encoded with 6 bits per subframe. It is to be noted that in cases where the average bit rate needs to be further reduced, unvoiced quarter-rate can be used in case of stable unvoiced frames.

A generic half-rate mode is used for low energy segments. This generic HR mode can be also used in maximum half-rate operation as will be explained later. The bit allocation of the Generic HR is shown in the above Table 3.

As an example, for classification information for the different HR coders, in case of Generic HR, 1 bit is used to indicate if the frame is Generic HR or other HR. In case of Unvoiced HR, 2 bits are used for classification: the first bit to indicate that the frame is not Generic HR and the second bit to indicate it is Unvoiced HR and not Voiced HR or Interoperable HR (to be explained later). In case of Voiced HR, 3 bits are used: the first 2 bits indicate that the frame is not Generic or Unvoiced HR, and the third bit indicates whether the frame is Unvoiced or Interoperable HR.

In the Economy mode, most of the unvoiced frames can be encoded using the Unvoiced QR coder. In this case, the Gaussian codebook indices are generated randomly and the gain is encoded with only 5 bits per subframe. Also, the LP filter coefficients are quantized with lower bit rate. 1 bit is used for the discrimination among the two quarter-rate coding types: Unvoiced QR and CNG QR. The bit allocation for unvoiced coding types is given in 6.

The Interoperable HR coding type allows coping with the situations where the CDMA system imposes HR as a maximum rate for a particular frame while the frame has been classified as full rate. The Interoperable HR is directly derived from the full rate coder by dropping the fixed codebook indices after the frame has been encoded as a full rate frame (Table 4). At the decoder side, the fixed codebook indices can be randomly generated and the decoder will operate as if it is in full-rate. This design has the advantage that it minimizes the impact of the forced half-rate mode during a tandem free operation between the CDMA system and other systems using the AMR-WB standard (such as the mobile GSM system or W-CDMA third generation wireless system). As mentioned earlier, the Interoperable FR coding type or CNG QR is used for a tandem-free operation (TFO) with AMR-WB. In the link with the direction from CDMA2000 to a system using AMR-WB codec, when the multiplex sub-layer indicates a request for half-rate mode, the VMR-WB codec will use the Interoperable HR coding type. At the system interface, when an Interoperable HR frame is received, randomly generated algebraic codebook indices are added to the bit stream to output a 12.65 kbit/s rate. The AMR-WB decoder at the receiver side will interpret it as an ordinary 12.65 kbit/s frame. In the other direction, that is in a link from a system using AMR-WB codec to CDMA2000, if at the system interface a half-rate request is received, then the algebraic codebook indices are dropped and mode bits indicating the Interoperable HR frame type are added. The decoder at the CDMA2000 side operates as an Interoperable HR coding type, which is a part of the VMR-WB coding solution. Without the Interoperable HR, a forced half-rate mode would be interpreted as a frame erasure.

The Comfort Noise Generation (CNG) technique is used for processing of inactive speech frames. The CNG eighth rate (ER) coding type is used to encode inactive speech frames when operating within the CDMA system. In a call where an interoperation with AMR-WB speech coding standard is required, the CNG ER cannot be always used as its bit rate is lower than the bit rate necessary to transmit the update information for the CNG decoder in AMR-WB (see 3 GPP TS 26.192, "AMR Wideband Speech Codec; Comfort Noise Aspects," 3 *GPP Technical Specification*). In this case, the CNG QR is used. However, the AMR-WB codec operates often in Discontinuous Transmission Mode (DTX). During discontinuous transmission, the background noise information is not updated every frame. Typically only one frame out of 8 consecutive inactive speech frames is transmitted. This update frame is referred to as Silence Descriptor (SID) (see 3GPP TS 26.193: "AMR Wideband Speech Codec; Source Controlled Rate operation," 3 *GPP Technical Specification*). The DTX operation is not used in the CDMA system where every frame is encoded. Consequently, only SID frames need to be encoded with CNG QR at the CDMA side and the remaining frames can be still encoded with CNG ER to lower the ADR as they are not used by the AMR-WB counterpart. In CNG coding, only the LP filter parameters and a gain are encoded once per frame. The bit allocation for the CNG QR is given in Table 4 and that of CNG ER is given in Table 5.

TABLE 4

Bit Allocation for the Unvoiced QR and CNG QR coding types

| Parameter | Unvoiced QR | CNG QR |
|---|---|---|
| Selection bits | 1 | 1 |
| LP Parameters | 32 | 28 |
| Gains | 20 | 6 |
| Unused bits | 1 | 19 |
| Total | 54 | 54 |

TABLE 5

Bit Allocation for the CNG ER

| Parameter | CNG ER Bits/Frame |
|---|---|
| LP Parameters | 14 |
| Gain | 6 |
| Unused | — |
| Total | 20 |

Signal Classification and Rate Selection in the Premium Mode

Figure 5:
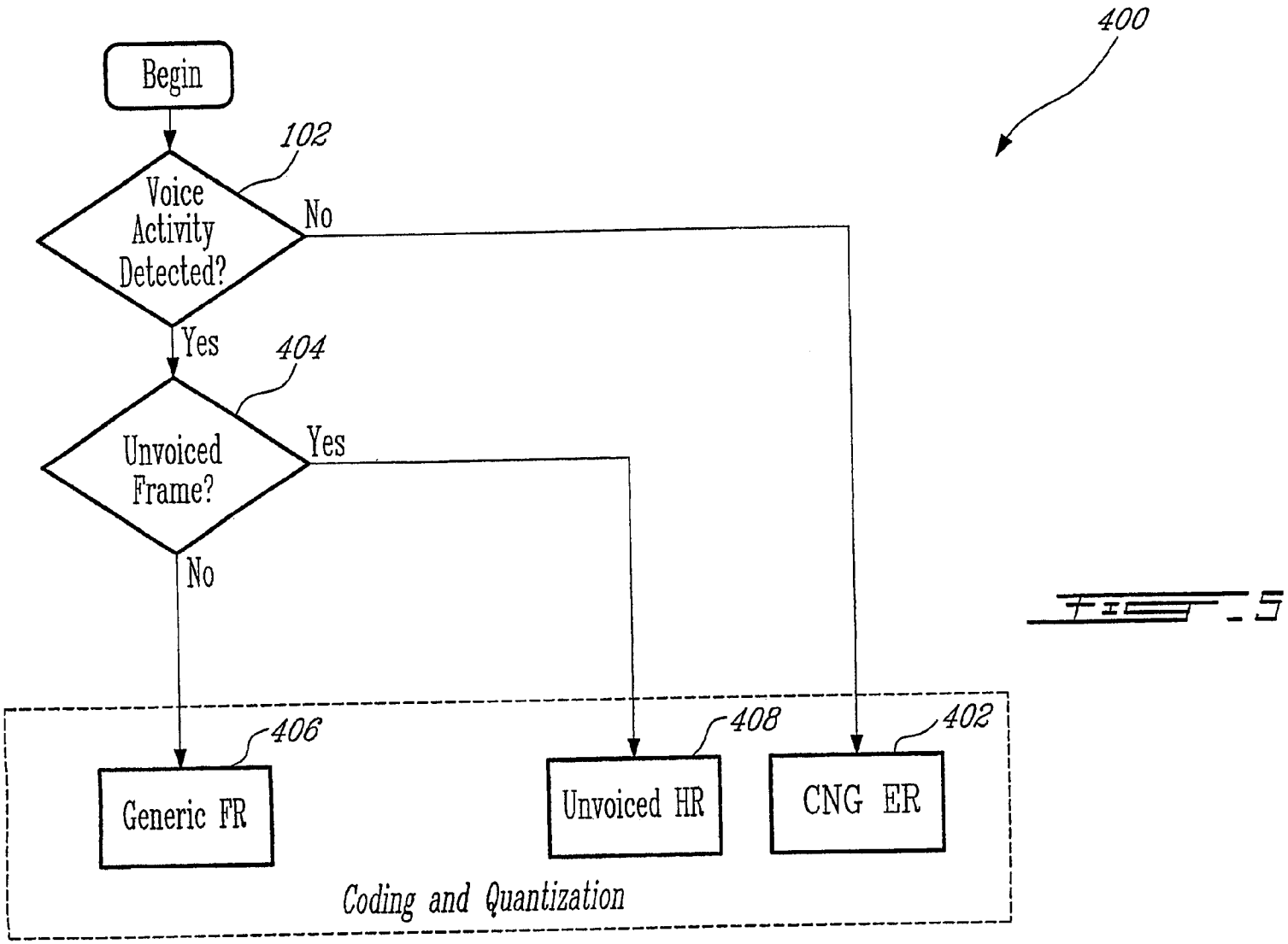
FIG. 5 is a flowchart illustrating a method for digitally encoding a sound signal in the Premium mode according to a second illustrative embodiment of the second aspect of the present invention.

A method 400 for digitally encoding a sound signal according to a second illustrative embodiment of the second aspect of the present invention is illustrated in FIG. 5. It is to be noted that the method 400 is a specific application of the method 100 in the Premium Mode, which is provided for maximum synthesized speech quality given the available bit rates (it should be noted that the case when the system limits the maximum available rate for a particular frame will be described in a separate subsection). Consequently, most of the active speech frames are encoded at full rate, i.e. 13.3 kb/s.

Similarly to the method 100 illustrated in FIG. 2, a voice activity detector (VAD), discriminates between active and inactive speech frames (step 102). The VAD algorithm can be identical for all modes of operation. If an inactive speech frame is detected (background noise signal) then the classification method stops and the frame is encoded with CNG ER coding type at 1.0 kbit/s according to CDMA Rate Set II (step 402). If an active speech frame is detected, the frame is subjected to a second classifier dedicated to discriminate unvoiced frames (step 404). As the Premium Mode is aimed for the best possible quality, the unvoiced frame discrimination is very severe and only highly stationary unvoiced frames are selected. The unvoiced classification rules and decision thresholds are as given above. If the second classifier classifies the frame as unvoiced speech signal, the classification method stops, and the frame is encoded using Unvoiced HR coding type (step 408) optimized for unvoiced signals (6.2 kbit/s according to CDMA Rate Set II). All other frames are processed with Generic FR coding type, based on the AMR-WB standard at 12.65 kbit/s (step 406).

Signal Classification and Rate Selection in the Standard Mode

Figure 6:
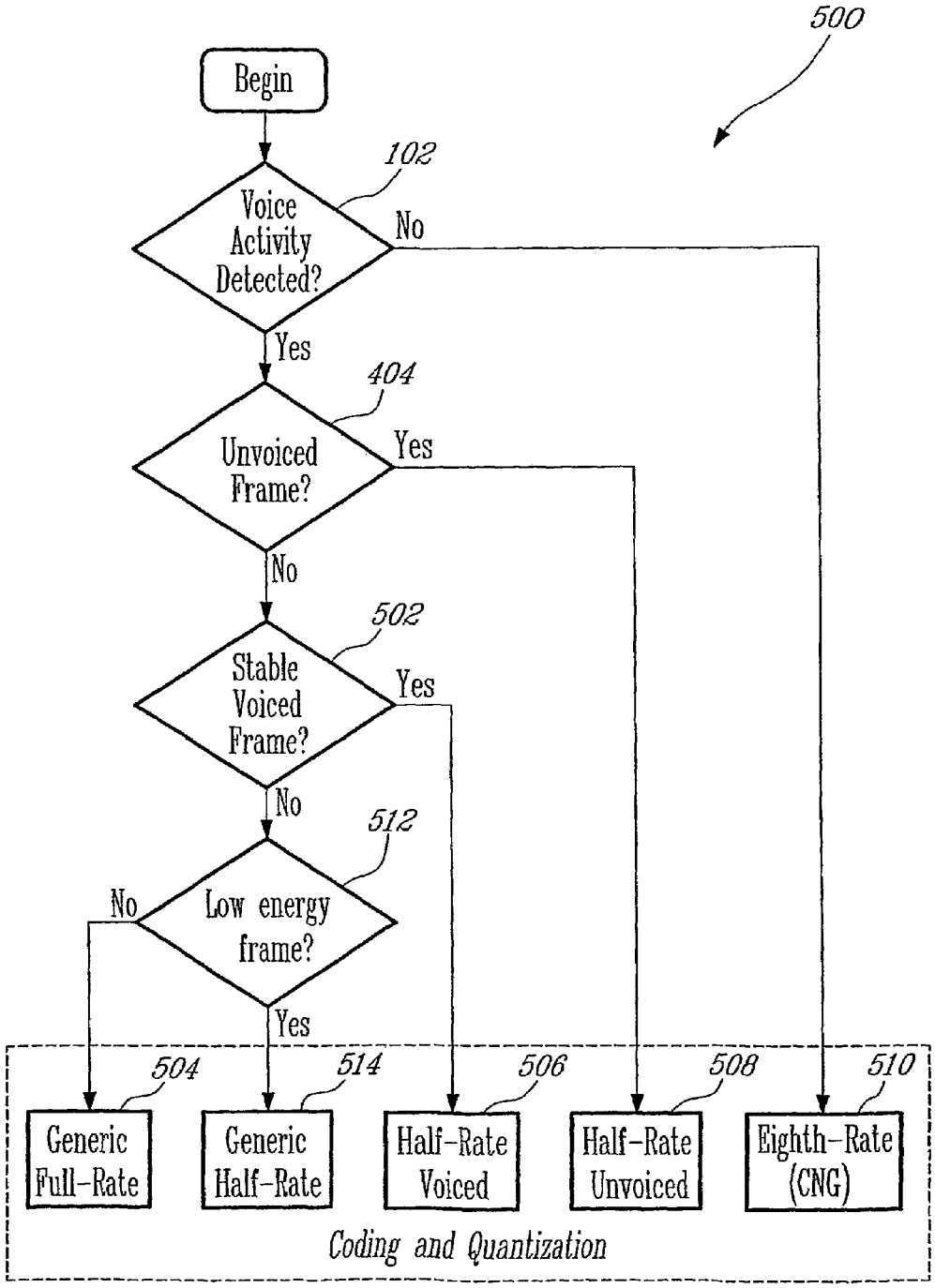
FIG. 6 is a flowchart illustrating a method for digitally encoding a sound signal in the Standard mode according to a third illustrative embodiment of the second aspect of the present invention.

A method 500 for digitally encoding a sound signal according to a third illustrative-embodiment of the second aspect of the present invention is illustrated in FIG. 6. The method 500 allows the classification of a speech signal and its encoding in Standard mode.

In step 102, a VAD discriminates between active and inactive speech frames. If an inactive speech frame is detected then the classification method stops and the frame is encoded as a CNG ER frame (step 510). If an active speech frame is detected, the frame is subjected to a second-level classifier dedicated to discriminate unvoiced frames (step 404). The unvoiced classification rules and decision thresholds are described above. If the second-level classifier classifies the frame as unvoiced speech signal, the classification method stops, and the frame is encoded with an Unvoiced HR coding type (step 508). Otherwise, the speech frame is passed through to the "stable voiced" classification module (step 502). The discrimination of the voiced frames is an inherent feature of the signal modification algorithm as described hereinabove. If the frame is suitable for signal modification, it is classified as stable voiced frame and encoded with Voiced HR coding type (step 506) in a module optimized for stable voiced signals (6.2 kbit/s according to CDMA Rate Set II). Otherwise, the frame is likely to contain a nonstationary speech segment such as a voiced onset or rapidly evolving voiced speech signal. These frames typically require a high bit rate for sustaining good subjective quality. However, if the energy of the frame is lower than a certain threshold then the frames can be encoded with a Generic HR coding type. Thus, if in step 512 the fourth-level classifier detects a low energy signal the frame is encoded using Generic HR (step 514). Otherwise, the speech frame is encoded as a Generic FR frame (13.3 kbit/s according to CDMA Rate Set II) (step 504).

Signal Classification and Rate Selection in the Economy Mode

A method 600 for digitally encoding a sound signal according to a fourth illustrative embodiment of the first aspect of the present invention is illustrated in FIG. 6. The method 600, which is a four-level classification method, allows the classification of a speech signal and its encoding in the Economy mode.

The Economy Mode allows for maximum system capacity still producing high quality wideband speech. The rate determination logic is similar to Standard mode with the exception that also Unvoiced QR coding type is used and Generic FR use is reduced.

First, in step 102, a VAD discriminates between active and inactive speech frames. If an inactive speech frame is detected then the classification method stops and the frame is encoded as a CNG ER frame (step 402). If an active speech frame is detected, the frame is subjected to a second classifier dedicated to discriminate all unvoiced frames (step 106). The unvoiced classification rules and decision thresholds have been described above. If the second classifier classifies the frame as unvoiced speech signal, the speech frame is passed into the a first third-level classifier (step 602). The third-level classifier checks whether the frame is on a voiced-unvoiced transition using the rules described above. In particular, this third-level classifier tests whether the last frame is either unvoiced of background noise frame, and if at the end of the frame the energy is concentrated in high frequencies and no potential voiced onset is detected in the lookahead. As explained above, the last two conditions are detected as:

$$(r_x(2)<\mathrm{th}_{12}) \text{ AND } (e_{tilt}(1)<\mathrm{th}_{13})$$

with $\mathrm{th}_{12}=0.73$, $\mathrm{th}_{13}=3$, where $r_x(2)$ is the correlation in the lookahead and $e_{tilt}(1)$ is the tilt in the second spectral analysis which spans the end of the frame and the lookahead.

If the frame contains a voiced-unvoiced transition, the frame is encoded in step 508 with Unvoiced HR coding type. Otherwise, the speech frame is encoded with Unvoiced QR coding type (step 604). Frames not classified as unvoiced are passed through to a "stable voiced" classification module, which is a second third-level classifier (step 110). The discrimination of the voiced frames is an inherent feature of the signal modification algorithm as explained earlier. If the frame is suitable for signal modification, it is classified as stable voiced frame and encoded with Voiced HR in step 506. Similar to the Standard mode, remaining frames (not classified as unvoiced or stable voiced) are tested for low energy content. If a low energy signal is detected in step 512, the frame is encoded in step 514 using Generic HR. Otherwise, the speech frame is encoded as a Generic FR frame (13.3 kbit/s according to CDMA Rate Set II) (step 504).

Signal Classification and Rate Selection in the Interoperable Mode

Figure 8:
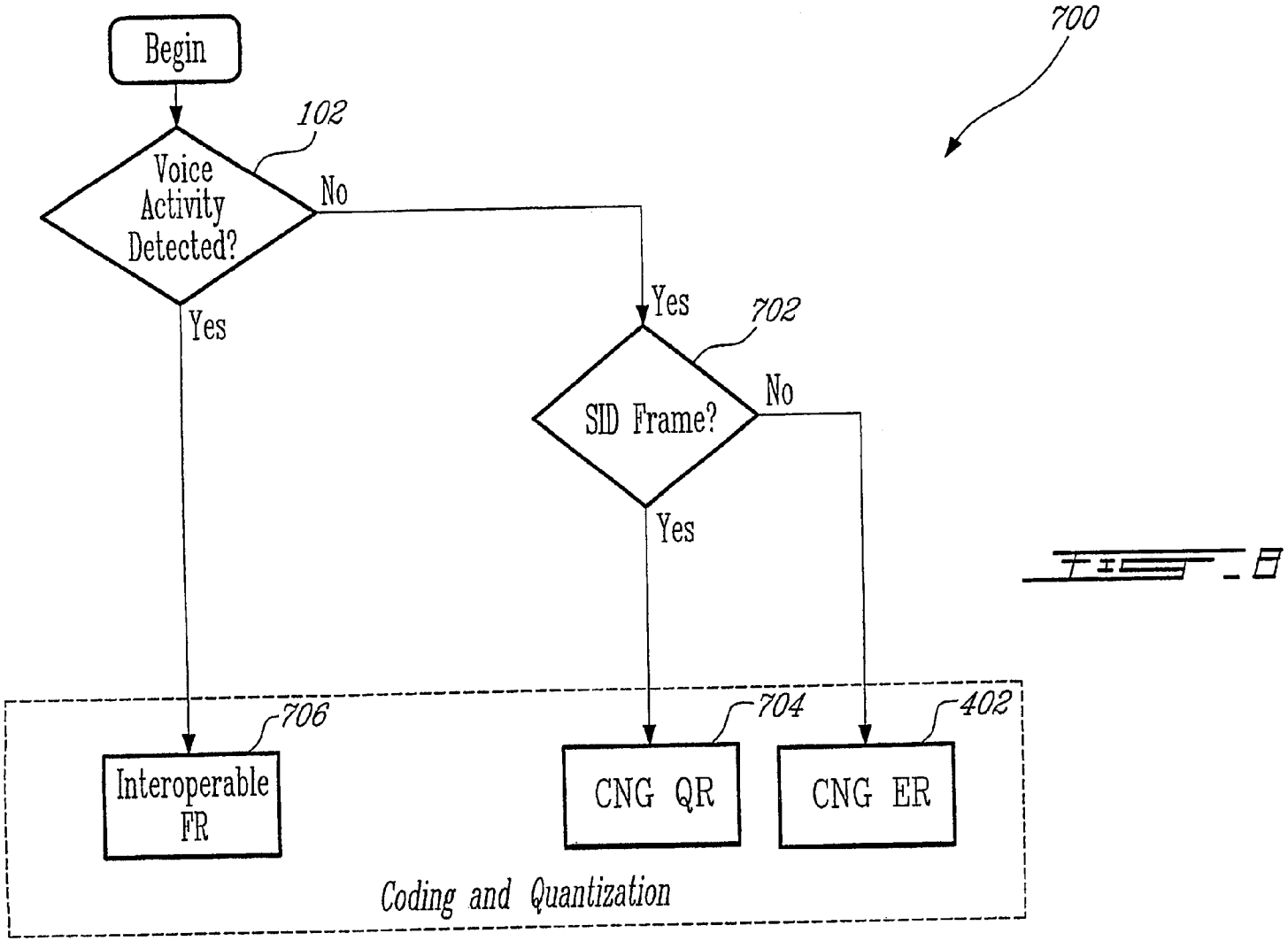
FIG. 8 is a flowchart illustrating a method for digitally encoding a sound signal in the Interoperable mode according to a fifth illustrative embodiment of the second aspect of the present invention.

A method 700 for digitally encoding a sound signal according to a fifth illustrative embodiment of the second aspect of the present invention is illustrated in FIG. 8. The method 700 allows the classification of a speech signal and the encoding in the Interoperable mode.

The Interoperable mode allows for a tandem free operation between the CDMA system and other systems using the AMR-WB standard at 12.65 kbit/s (or lower rates). In absence of rate limitation imposed by the CDMA system, only Interoperable FR and Comfort Noise Generators are used.

First, in step 102, a VAD discriminates between active and inactive speech frames. If an inactive speech frame is detected, a decision is made in step 702 whether the frame should be encoded as a SID frame. As mentioned earlier, the SID frame serves to update the CNG parameters at AMR-WB side during DTX operation (3GPP TS 26.193: "AMR Wideband Speech Codec; Source Controlled Rate operation," 3 *GPP Technical Specification*). Typically, only one of 8 inactive speech frames are encoded during silence periods. However, after an active speech segment, the SID update must be sent already in the $4^{th}$ frame (see 3 GPP TS 26.193: "AMR Wideband Speech Codec; Source Controlled Rate operation," 3 *GPP Technical Specification* for more details). As the ER is not sufficient to encode a SID frame, SID frames are encoded with CNG QR in step 704. Other than SID inactive frames are encoded with CNG ER in step 402. In the link with the direction from CDMA VMR-WB to AMR-WB in a Tandem Free Operation (TFO), the CNG ER frames are discarded at the system interface as AMR-WB does not make use of them. In the opposite direction, those frames are not available (AMR-WB is generating only SID frames) and are declared as frame erasures. All active speech frames are processed with Interoperable FR coding type (step 706), which is essentially the AMR-WB coding standard at 12.65 kbit/s.

Signal Classification and Rate Selection in Half-Rate Max Operation

Figure 9:
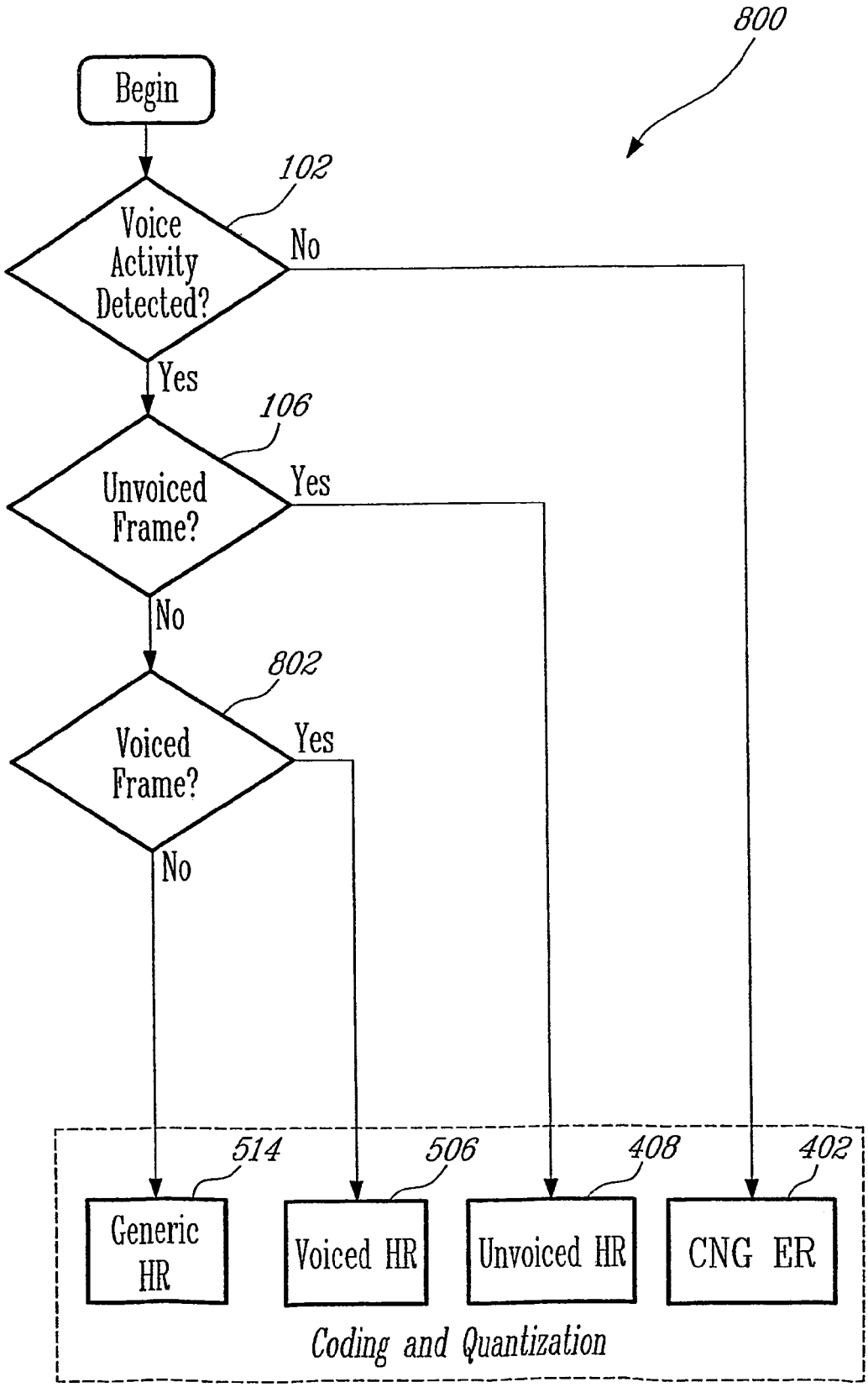
FIG. 9 is a flowchart illustrating a method for digitally encoding a sound signal in the Premium or Standard mode during half-rate max according to a sixth illustrative embodiment of the second aspect of the present invention.

A method 800 for digitally encoding a sound signal according to a sixth illustrative embodiment of the second aspect of the present invention is illustrated in FIG. 9. The method 800 allows the classification of a speech signal and the encoding in Half-Rate Max operation for Premium and Standard modes.

As discussed hereinabove, the CDMA system imposes a maximum bit rate for a particular frame. Most often, the maximum bit rate imposed by the system is limited to HR. However, the system can impose also lower rates.

All active speech frames that would conventionally be classified as FR during normal operation are now encoded using HR coding types. The classification and rate selection mechanism classifies then all such voiced frames using Voiced HR (encoded in step 506) and all such unvoiced frames using Unvoiced HR (encoded in step 408). All remaining frames that would be classified as FR during normal operation are encoded using the Generic HR coding type in step 514 except in the Interoperable mode where Interoperable HR coding type is used (step 908 on FIG. 10).

As can be seen on FIG. 9, the signal classification and encoding mechanism is similar to the normal operation in Standard mode. However, the Generic HR (step 514) is used instead of the Generic FR coding (step 406 on FIG. 5) and the thresholds used to discriminate unvoiced and voiced frames are more relaxed to allow as many frames as possible to be encoded using the Unvoiced HR and Voiced HR coding types. Basically, the thresholds for Economy mode are used in case of Premium or Standard mode half-rate max operation.

Figure 7:
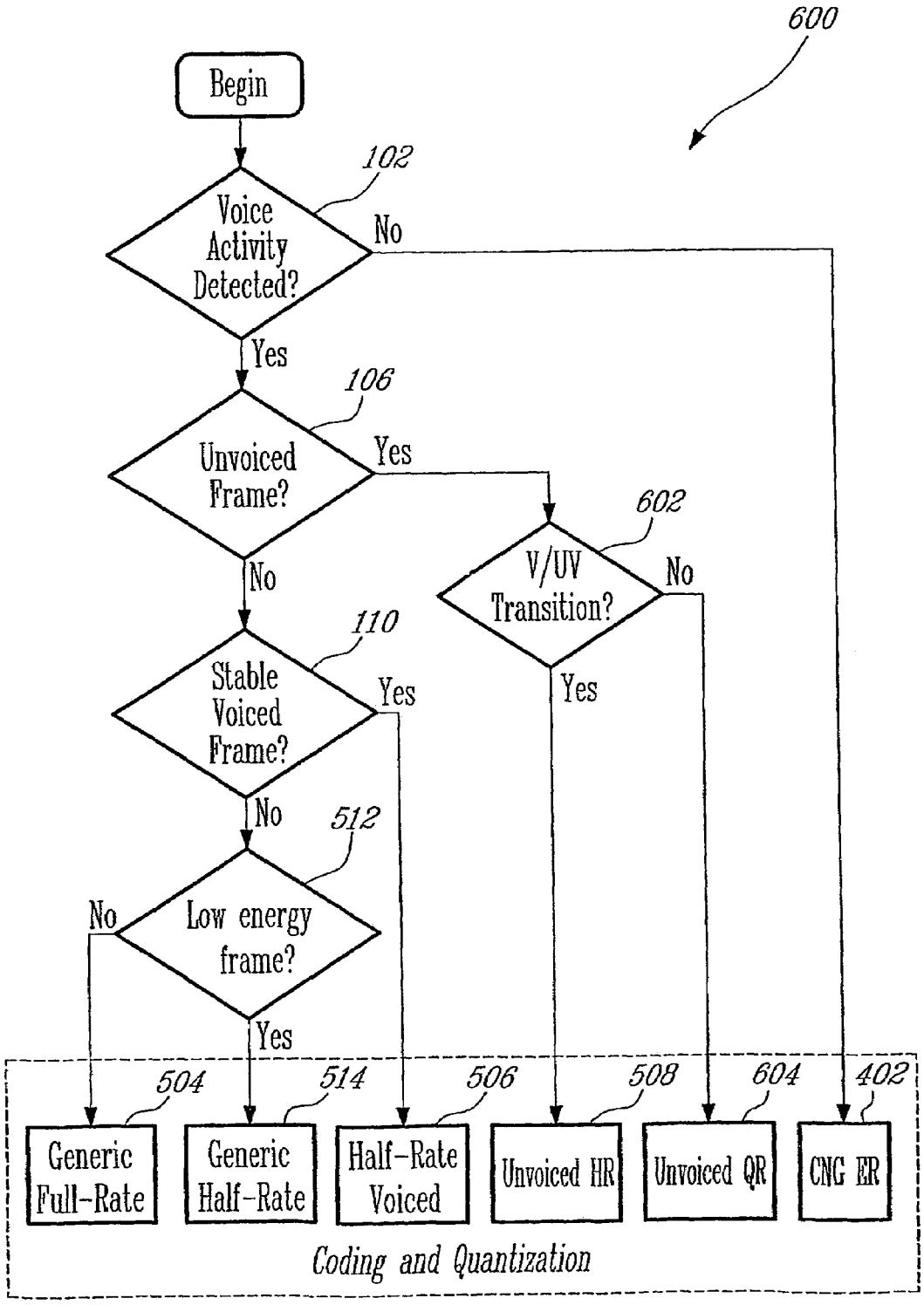
FIG. 7 is a flowchart illustrating a method for digitally encoding a sound signal in the Economy mode according to a fourth illustrative embodiment of the second aspect of the present invention.
Figure 11:
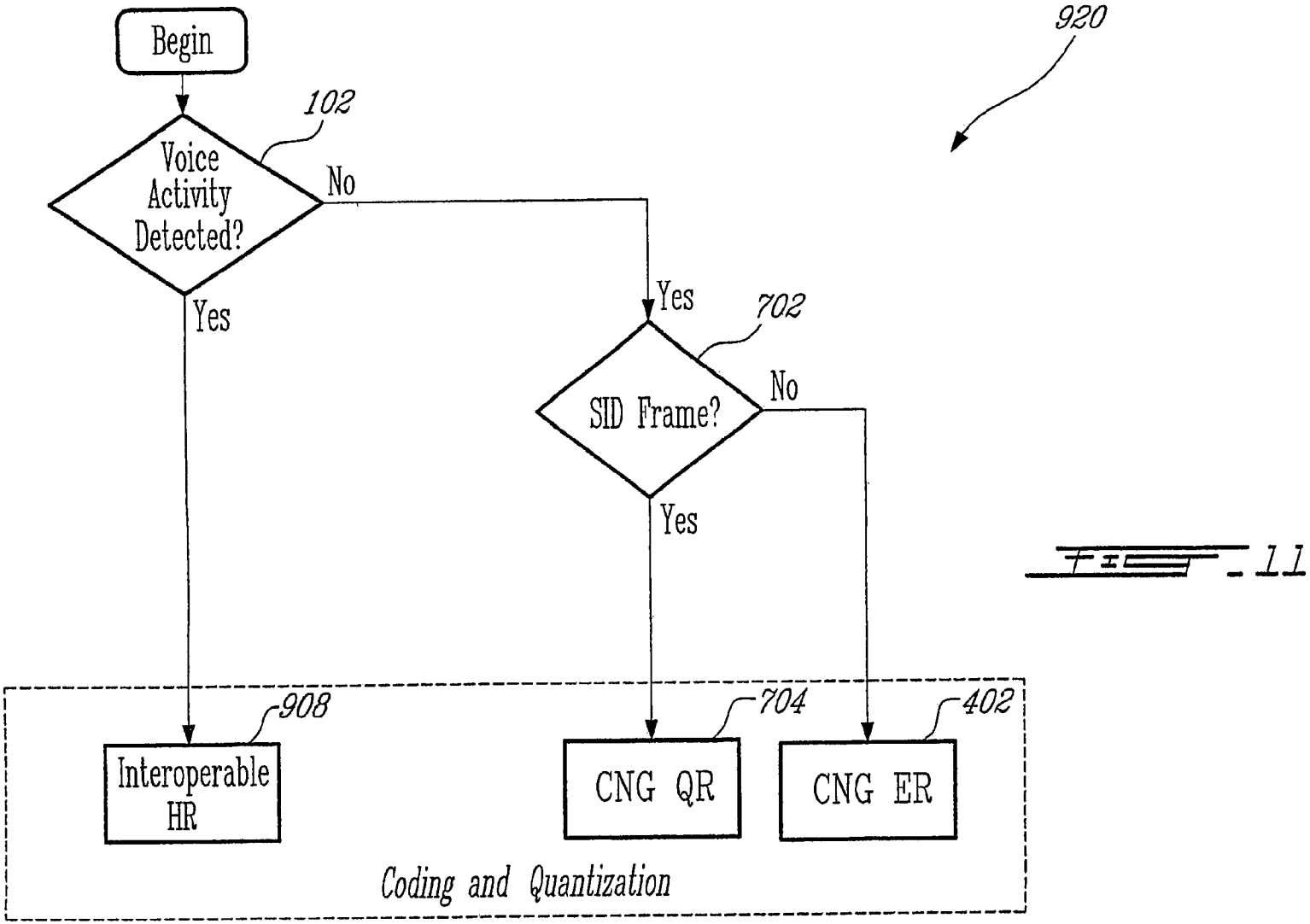
FIG. 11 is a flowchart illustrating a method for digitally encoding a sound signal in the Interoperable mode during half-rate max according to a eighth illustrative embodiment of the second aspect of the present invention.

A method 900 for digitally encoding a sound signal according to a seventh illustrative embodiment of the first aspect of the present invention is illustrated in FIG. 10. The method 900 allows the classification of a speech signal and the encoding in Half-Rate Max operation for the Economy mode. The method 900 in FIG. 10 is similar to the method 600 in FIG. 7 with the exception that all frames that would have been encoded with Generic FR are now encoded with Generic HR (no need for low energy frame classification in half-rate max operation). A method 920 for digitally encoding a sound signal according to a eighth illustrative embodiment of the first aspect of the present invention is illustrated in FIG. 11. The method 920 allows the classification of a speech signal and the rate determination in the Interoperable mode during half-rate max operation. Since the method 920 is very similar to the method 700 from FIG. 8, only the differences between the two methods will be described herein.

In the case of method 920, no signal specific coding types (Unvoiced HR and Voiced HR) can be used as they would not be understandable by AMR-WB counterpart, and also no Generic HR coding can be used. Consequently, all active speech frames in half-rate max operation are encoded using the Interoperable HR coding type.

If the system imposes a lower maximum bit rate than HR, no general coding type is provided to cope with those cases, essentially because those cases are extremely rare and such frames can be declared as frame erasures. However, if the maximum bit rate is limited to QR by the system and the signal is classified as unvoiced, then Unvoiced QR can be used. This is however possible only in CDMA specific modes (Premium, Standard, Economy), as the AMR-WB counterpart is unable to interpret the QR frames.

Efficient Interoperation between AMR-WB and Rate Set II VMR-WB Codec

A method 1000 for coding a speech signal for interoperation between AMR-WB and VMR-WB codecs will now be described according to an illustrative embodiment of fourth aspect of the present invention with reference to FIG. 12.

More specifically, the method 1000 enables tandem-free operation between the AMR-WB standard codec and the source controlled VBR codec designed, for example, for CDMA2000 systems (referred to here as VMR-WB codec). In an Interoperable mode allowed by the method 1000, the VMR-WB codec makes use of bit rates that can be interpreted by the AMR-WB codec and still fit within the Rate Set II bit rates used in a CDMA codec, for example.

As the bit rate of Rate Set II are the FR 13.3, HR 6.2, QR 2.7, and ER 1.0 kbit/s, then the AMR-WB codec bit rates that can be used are 12.65, 8.85, or 6.6 in the full rate, and the SID frames at 1.75 kbit/s in the quarter rate. AMR-WB at 12.65 kbit/s is the closest in bit rate to CDMA2000 FR 13.3 kbit/s and it is used as the FR codec in this illustrative embodiment. However, when AMR-WB is used in GSM systems the link adaptation algorithm can lower the bit rate to 8.85 or 6.6 kbit/s depending on the channel conditions (in order to allocate more bits to channel coding). Thus, the 8.85 and 6.6 kbit/s bit rates of AMR-WB can be part of the Interoperable mode and can be used at the CDMA2000 receiver in case the GSM system decided to use either of these bit rates. In the illustrative embodiment of FIG. 12, three types of I-FR are used corresponding to AMR-WB rates at 12.65, 8.85, and 6.6 kbit/s and will be denoted I-FR-12, I-FR-8, and I-FR-6, respectively. In I-FR-12, there are 13 unused bits. The first 8 bits are used to distinguish I-FR frames and Generic FR frames (that use the extra bits to improve frame erasure concealment). The other 5 bits are used to signal the three types of I-FR frames. In ordinary operation, I-FR-12 is used and the lower rates are used if required by the GSM link adaptation.

In the CDMA2000 system, the average data rate of the speech codec is directly related to the system capacity. Therefore attaining the lowest ADR possible with a minimal loss in speech quality becomes of significant importance. The AMR-WB codec was mainly designed for GSM cellular systems and third generation wireless based on GSM evolution. Thus an Interoperable mode for CDMA2000 system may result in a higher ADR compared to VBR codec specifically designed for CDMA2000 systems. The main reasons are:

- The lack of a half rate mode at 6.2 kbit/s in AMR-WB;
- The bit rate of the SID in AMR-WB is 1.75 kbit/s which doesn't fit in the Rate Set II eighth rate (ER);
- The VAD/DTX operation of AMR-WB uses several frames of hangover (encoded as speech frames) in order to compute the SID_FIRST frame.

An method for coding a speech signal for interoperation between AMR-WB and VMR-WB codecs allows to overcome the above mentioned limitations and result in reduced ADR of the Interoperable mode such that it is equivalent to CDMA2000 specific modes with comparable speech quality. The methods are described below for both directions of operation: VMR-WB encoding-AMR-WB decoding, and AMR-WB encoding-VMR-WB decoding.

VMR-WB Encoding-AMR-WB Decoding

When encoding at the CDMA VMR-WB codec side, the VAD/DTX/CNG operation of the AMR-WB standard is not required. The VAD is proper to VMR-WB codec and works exactly the same way as in the other CDMA2000 specific modes, i.e. the VAD hangover used is just as long as necessary for not to miss unvoiced stops, and whenever the VAD_flag=0 (background noise classified) CNG encoding is operating.

The VAD/CNG operation is made to be as close as possible to the AMR DTX operation. The VAD/DTX/CNG operation in the AMR-WB codec works as follows. Seven background noise frames after an active speech period are encoded as speech frames but the VAD bit is set to zero (DTX hangover). Then an SID_FIRST frame is sent. In an SID_FIRST frame the signal is not encoded and CNG parameters are derived out of the DTX hangover (the 7 speech frames) at the decoder. It is to be noted that AMR-WB doesn't use DTX hangover after active speech periods which are shorter than 24 frames in order to reduce the DTX hangover overhead. After an SID_FIRST frame, two frames are sent as NO_DATA frames (DTX), followed by an SID_UPDATE frame (1.75 kbit/s). After that, 7 NO_DATA frames are sent followed by an SID_UPDATE frame and so on. This continues until an active speech frame is detected (VAD_flag=1). (see 3 GPP TS 26.193: "AMR Wideband Speech Codec; Source Controlled Rate operation," 3 *GPP Technical Specification*).

Figure 12:
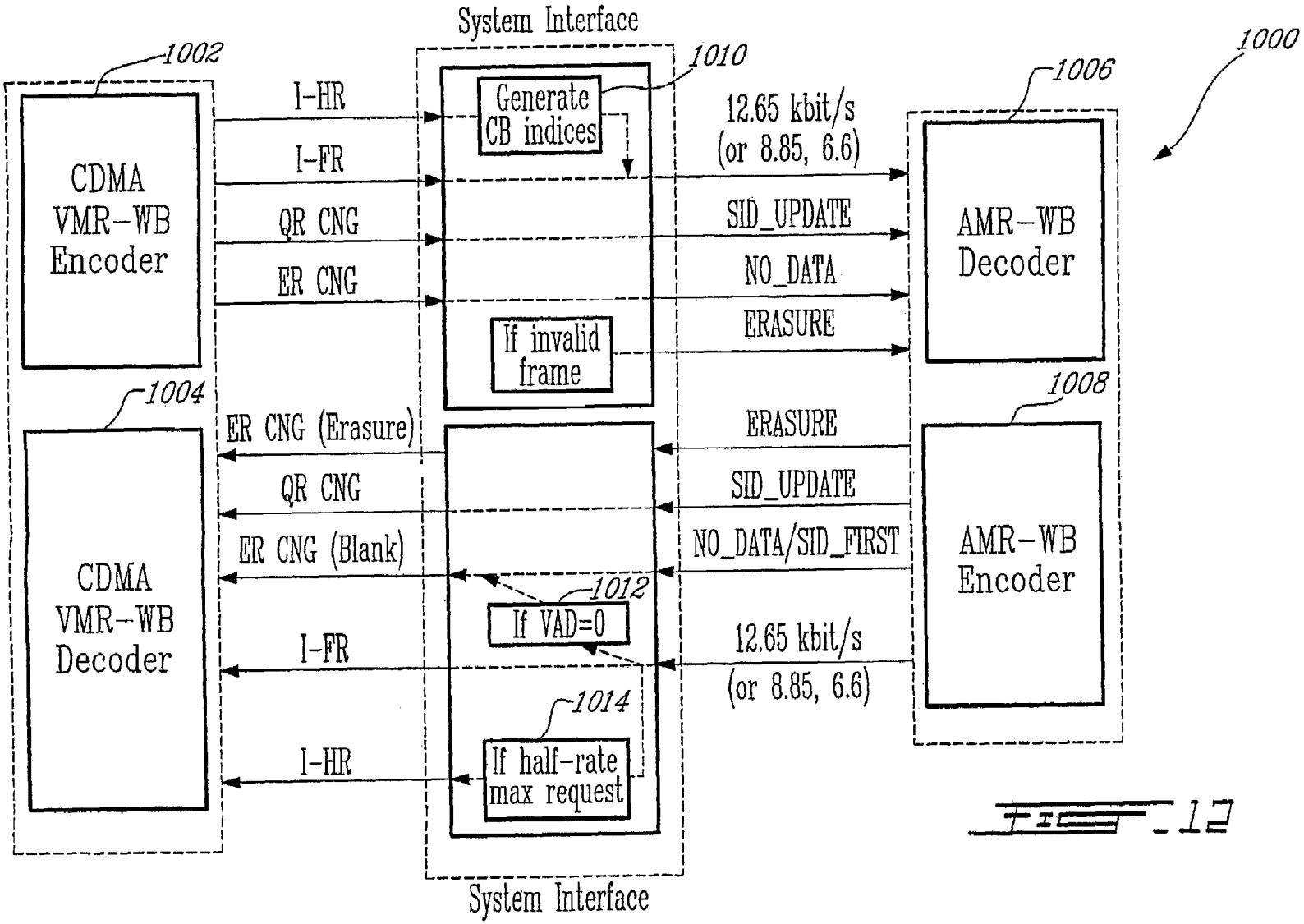
FIG. 12 is a flowchart illustrating a method for digitally encoding a sound signal so as to allow interoperation between VMR-WB and AMR-WB codecs, according to an illustrative embodiment of a fifth aspect of the present invention.

In the illustrative embodiment of FIG. 12, the VAD in the VMR-WB codec doesn't use DTX hangover. The first background noise frame after an active speech period is encoded at 1.75 kbit/s and sent in QR, then there are 2 frames encoded at 1 kbit/s (eighth rate) and then another frame at 1.75 kbit/s sent in QR. After that, 7 frames are sent in ER followed by one QR frame and so on. This corresponds roughly to AMR-WB DTX operation with the exception that no DTX hangover is used in order to reduce the ADR.

Although the VAD/CNG operation in the VMR-WB codec described in this illustrative embodiment is close to the AMR-WB DTX operation, other methods can be used which can reduce further the ADR. For example, QR CNG frames can be sent less frequently, e.g. once every 12 frames. Further, the noise variations can be evaluated at the encoder and QR CNG frames can be sent only when noise characteristics change (not once every 8 or 12 frames).

In order to overcome the limitation of the non-existence of a half rate at 6.2 kbit/s in the AMR-WB encoder, an Interoperable half rate (I-HR) is provided which includes encoding the frame as a full rate frame then dropping the bits corresponding to the algebraic codebook indices (144 bits per frame in AMR-WB at 12.65 kbit/s). This reduces the bit rate to 5.45 kbit/s which fits in the CDMA2000 Rate Set II half rate. Before decoding, the dropped bits can be generated either randomly (i.e. using a random generator) or pseudo-randomly (i.e. by repeating part of the existing bitstream) or in some predetermined manner. The I-HR can be used when dim-and-burst or half-rate max request is signaled by the CDMA2000 system. This avoids declaring the speech frame as a lost frame. The I-HR can be also used by the VMR-WB codec in Interoperable mode to encode unvoiced frames or frames where the algebraic codebook contribution to the synthesized speech quality is minimal. This results in a reduced ADR. It should be noted that in this case, the encoder can choose frames to be encoded in I-HR mode and thus minimize the speech quality degradation caused by the use of such frames.

As illustrated in FIG. 12, in the direction VMR-WB encoding/AMR-WB decoding, the speech frames are encoded with Interoperable mode of the VMR-WB encoder 1002, which outputs one of the following possible bit rates: I-FR for active speech frames (I-FR-12, I-FR-8, or I-FR-6), I-HR in case of dim-and-burst signaling or, as an option, to encode some unvoiced frames or frames where the algebraic codebook contribution to the synthesized speech quality is minimal, QR CNG to encode relevant background noise frames (one out of eight background noise frames as described above, or when a variation in noise characteristic is detected), and ER CNG frames for most background noise frames (background noise frames not encoded as QR CNG frames). At the system interface, which is in the form of a gateway, the following operations are performed:

First, the validity of the frame received by the gateway from the VMR-WB encoder is tested. If it is not a valid Interoperable mode VMR-WB frame then it is sent as an erasure (speech lost type of AMR-WB). The frame is considered invalid for example if one of the following conditions occurs:

- If all-zero frame is received (used by the network in case of blank and burst) then the frame is erased;
- In case of FR frames, if the 13 preamble bits do not correspond to I-FR-12, I-FR-8, or I-FR-6, or if the unused bits are not zero, then the frame is erased. Also, I-FR sets the VAD bit to 1 so if the VAD bit of the received frame is not 1 the frame is erased;
- In case of HR frames, similar to FR, if the preamble bits do not correspond to I-HR-12, I-HR-8, or I-HR-6, or if the unused bits are not zero, then the frame is erased. Same for the VAD bit;
- In case of QR frames, if the preamble bits do not correspond to CNG QR then the frame is erased. Further, the VMR-WB encoder sets the SID_UPDATE bit to 1 and the mode request bits to 0010. If this is not the case then the frame is erased;
- In case of ER frames, if all-one ER frame is received then the frame is erased. Further, the VMR-WB encoder uses the all zero ISF bit pattern (first 14 bits) to signal blank frames. If this pattern is received then the frame is erased.

If the received frame is a valid Interoperable mode frame the following operations are performed:

- I-FR frames are sent to AMR-WB decoder as 12.65, 8.8, or 6.6 kbit/s frames depending on the I-FR type;
- QR CNG frames are sent to the AMR-WB decoder as SID_UPDATE frames;
- ER CNG frames are sent to AMR-WB decoder as NO_DATA frames; and
- I-HR frames are translated to 12.65, 8.85, or 6.6 kbit/s frames (depending on the frame type) by generating the missing algebraic codebook indices in step 1010. The indices can be generated randomly, or by repeating part of the existing coding bits or in some predetermined manner. It also discards bits indicating the I-HR type (bits used to distinguish different half rate types in the VMR-WB codec).

AMR-WB Encoding-VMR-WB Decoding

In this direction, the methods 1000 is limited by the AMR-WB DTX operation. However, during the active speech encoding, there is one bit in the bitstream (the 1st data bit) indicating VAD_flag (0 for DTX hangover period, 1 for active speech). So the operation at the gateway can be summarized as follows:

- SID_UPDATE frames are forwarded as QR CNG frames;
- SID_FIRST frames and NO_DATA frames are forwarded as ER blank frames;
- Erased frames (speech lost) are forwarded as ER erasure frames;

The first frame after active speech with VAD_flag=0 (verified in step 1012) is kept as FR frame but the following frames with VAD_flag=0 are forwarded as ER blank frames;

If the gateway receives in step 1014 a request for half-rate-max operation (frame-level signaling) while receiving FR frames, then the frame is translated into a I-HR frame. This consists of dropping the bits corresponding to algebraic codebook indices and adding the mode bits indicating the I-HR frame type.

In this illustrative embodiment, in ER blank frames, the first two bytes are set to 0x00 and in ER erasure frames the first two bytes are set to 0x04. Basically, the first 14 bits correspond to the ISF indices and two patterns are reserved to indicate blank frames (all-zero) or erasure frames (all-zero except 14th bit set to 1, which is 0x04 in hexadecimal). At the VMR-WB decoder 1004, when blank ER frames are detected, they are processed by the CNG decoder by using the last received good CNG parameters. An exception is the case of the first received blank ER frame (CNG decoder initialization; no old CNG parameters are known yet). Since the first frame with VAD_flag=0 is transmitted as FR, the parameters from this frame as well as last CNG parameters are used to initialize CNG operation. In case of ER erasure frames, the decoder uses the concealment procedure used for erased frames.

Note that in the illustrated embodiment shown in FIG. 12, 12.65 kbit/s is used for FR frames. However, 8.85 and 6.6 kbit/s can equally be used in accordance with a link adaptation algorithm that requires the use of lower rates in case of bad channel conditions. For example, for interoperation between CDMA2000 and GSM systems, the link adaptation module in GSM system may decide to lower the bit rate to 8.85 or 6.6 kbit/s in case of bad channel conditions. In this case, these lower bit rates need to be included in the CDMA VMR-WB solution.

CDMA VMR-WB Codec Operating in Rate Set I

In Rate Set I, the bit rates used are 8.55 kbit/s for FR, 4.0 kbit/s for HR, 2.0 kbit/s for QR, and 800 bit/s for ER. In this case only AMR-WB codec at 6.6 kbit/s can be used at FR and CNG frames can be sent at either QR (SID_UPDATE) or ER for other background noise frames (similar to the Rate Set II operation described above). To overcome the limitation of the low quality of the 6.6 kbit/s rate, an 8.55 kbit/s rate is provided which is interoperable with the 8.85 kbit/s bit rate of AMR-WB codec. It will be referred to as Rate Set I Interoperable FR (I-FR-I). The bit allocation of the 8.85 kbit/s rate and two possible configurations of I-FR-I are shown in Table 6.

In the I-FR-I, the VAD_flag bit and additional 5 bits are dropped to obtain a 8.55 kbit/s rate. The dropped bits can be easily introduced at the decoder or system interface so that the 8.85 kbit/s decoder can be used. Several methods can be used to drop the 5 bits in a way that cause little impact on the speech quality. In Configuration 1 shown in Table 6, the 5 bits are dropped from the linear prediction (LP) parameter quantization. In AMR-WB, 46 bits are used to quantize the LP parameters in the ISP (immitance spectrum pair) domain (using mean removal and moving average prediction). The 16 dimensional ISP residual vector (after prediction) is quantized using split-multistage vector quantization. The vector is split into 2 subvectors of dimensions 9 and 7, respectively. The 2 subvectors are quantized in two stages. In the first stage each subvector is quantized with 8 bits. The quantization error vectors are split in the second stage into 3 and 2 subvectors, respectively. The second stage subvectors are of dimension 3, 3, 3, 3, and 4, and are quantized with 6, 7, 7, 5, and 5 bits, respectively. In the proposed I-FR-I mode, the 5 bits of the last second stage subvectors are dropped. These have the least impact since they correspond to the high frequency portion of the spectrum. Dropping these 5 bits is done in practice by fixing the index of the last second stage subvector to a certain value that doesn't need to be transmitted. The fact that this 5-bit index is fixed is easily taken into account during the quantization at the VMR-WB encoder. The fixed index is added either at the system interface (i.e. during VMR-WB encoder/AMR-WB decoder operation) or at the decoder (i.e during AMR-WB encoder/VMR-WB decoder operation). In this way the AMR-WB decoder at 8.85 kbit/s is used to decode the Rate Set I I-FR frame.

In a second configuration of the illustrated embodiment, the 5 bits are dropped from the algebraic codebook indices. In the AMR-WB at 8.85 kbit/s, a frame is divided into four 64-sample subframes. The algebraic excitation codebook consists on dividing the subframe into 4 tracks of 16 positions and placing a signed pulse in each track. Each pulse is encoded with 5 bits: 4 bits for the position and 1 bit for the sign. Thus, for each subframe, a 20-bit algebraic codebook is used. One way of dropping the five bits is to drop one pulse from a certain subframe. For example, the $4^{th}$ pulse in the $4^{th}$ position-track in the $4^{th}$ subframe. At the VMR-WB encoder, this pulse can be fixed to a predetermined value (position and sign) during the codebook search. This known pulse index can then be added at the system interface and sent to the AMR-WB decoder. In the other direction, the index of this pulse is dropped at the system

TABLE 6

Bit allocation of the I-FR-I coding types in Rate Set I configuration.

| Parameter | AMR-WB At 8.85 kbit/s Bits/Frame | I-FR-I at 8.55 kbit/s (configuration 1) Bits/Frame | I-FR-I at 8.55 kbit/s (configuration 2) Bits/frame |
|---|---|---|---|
| Half-rate mode bits | — | — | |
| VAD flag | 1 | 0 | 0 |
| LP Parameters | 46 | 41 | 46 |
| Pitch Delay | 26 = 8 + 5 + 8 + 5 | 26 | 26 |
| Gains | 24 = 6 + 6 + 6 + 6 | 24 | 24 |
| Algebraic Codebook | 80 = 20 + 20 + 20 + 20 | 80 | 75 |
| Total | 177 | 171 | 171 |

interface, and at the CDMA VMR-WB decoder, the pulse index can be randomly generated. Other methods can be also used to drop these bits.

To cope with a dim-and-burst or half-rate max request by the CDMA2000 system, an Interoperable HR mode is provided also for the Rate Set I codec (I-HR-I). Similarly to the Rate Set II case, some bits must be dropped at the system interface during AMR-WB encoding/VMR-WB decoding operation, or generated at the system interface during VMR-WB encoding/AMR-WB decoding. A bit allocation of the 8.85 kbit/s rate and an example configuration of I-HR-I is shown in Table 7.

TABLE 7

Example bit allocation of the I-HR-I coding type in Rate Set I configuration.

| Parameter | AMR-WB at 8.85 kbit/s Bits/Frame | I_HR-I at 4.0 Bits/Frame |
|---|---|---|
| Half-rate mode bits | — | — |
| VAD flag | 1 | 0 |
| LP Parameters | 46 | 36 |
| Pitch Delay | 26 = 8 + 5 + 8 + 5 | 20 |
| Gains | 24 = 6 + 6 + 6 + 6 | 24 |
| Algebraic Codebook | 80 = 20 + 20 + 20 + 20 | 0 |
| Total | 177 | 80 |

In the proposed I-HR-I mode, the 10 bits of the last 2 second stage subvectors in the quantization of the LP filter parameters are dropped or generated at the system interface in a manner similar to Rate Set II described above. The pitch delay is encoded only with integer resolution and with bit allocation of 7, 3, 7, 3 bits in four subframes. This translates in the AMR-WB encoder/VMR-WB decoder operation to dropping the fractional part of the pitch at the system interface and to clip the differential delay to 3 bits for the $2^{nd}$ and $4^{th}$ subframes. Algebraic codebook indices are dropped altogether similarly as in the I-HR solution of Rate Set II. The signal energy information is kept intact.

The rest of operation of the Rate Set I Interoperable mode is similar to the operation of the Rate Set II mode explained above in FIG. 12 (in terms of VAD/DTX/CNG operation) and will not be described herein in more detail.

Although the present invention has been described hereinabove by way of illustrative embodiments thereof, it can be modified without departing from the spirit and nature of the subject invention, as defined in the appended claims. For example, although the illustrative embodiments of the present invention are described in relation to encoding of a speech signal, it should be kept in mind that these embodiments also apply to sound signals other than speech.

What is claimed is:

1. An interworking apparatus, comprising a unit operable with a source-controlled Variable bit-rate Multi-mode Wide-Band (VMR-WB) codec providing a mode of operation that is interoperable with an Adaptive Multi-Rate wideband (AMR-WB) codec, where in a VMR-WB encoding/AMR-WB decoding case, speech frames are encoded in an AMR-WB interoperable mode of a VMR-WB encoder using one of bit rates corresponding to Interoperable-Full Rate (I-FR) for active speech frames, Interoperable-Half Rate (I-FIR) at least for dim-and-burst signaling, Quarter Rate-Comfort Noise Generator (CNG-QR) to encode at least relevant background noise frames and Eighth Rate-Comfort Noise Generator (CNG-ER) frames for background noise frames not encoded as CNG-QR frames, said interworking apparatus operable such that, invalid frames are transmitted to an AMR-WB decoder as erased frames;

I-FR frames are transmitted to the AMR-WB decoder as 12.65, 8.85 or 6.60 kbps AMR-WB frames depending on the I-FR type;

CNG-QR frames are transmitted to the AMR-WB decoder as Silence Descriptor Update (SID_UPDATE) frames;

CNG-ER frames are transmitted to the AMR-WB decoder as NO_DATA frames; and

I-HR frames are translated to 12.65, 8.85, or 6.60 kbps frames, depending on the frame type, by generating missing algebraic codebook indices, where bits indicating the I-HR type are discarded.

2. A method for encoding a speech signal according to a first speech coding scheme so that it can be decoded according to a second speech coding scheme, the speech signal comprising active speech periods during which there is active speech and inactive speech periods during which there is no active speech, the first speech coding scheme having a first set of available coding modes, each of said first set of coding modes having an associated encoding bit-rate, the second speech coding scheme having a second set of available coding modes including a discontinuous transmission coding mode in which silence descriptor frames are generated during inactive speech periods, the method comprising:

receiving an input speech signal for encoding according to the first speech coding scheme;

applying a speech frame derived from the input speech signal to a voice activity detection function to determine whether the speech frame is an active speech frame containing active speech or an inactive speech frame that does not contain active speech;

when it is determined that the input speech frame is an inactive speech frame, performing a determination operation according to a predetermined rule to specify whether, according to the second speech coding scheme, the inactive speech frame is to be encoded as a silence descriptor frame; and when it is determined that the input speech frame is to be encoded as a silence descriptor frame, encoding the input speech frame using a first predetermined encoding mode selected from said first set of available encoding modes that has an encoding bit-rate sufficiently high to allow encoding of the input speech frame with a number of bits compatible with a silence descriptor frame according to the second speech coding scheme;

when it is determined that the input speech frame is not to be encoded as a silence descriptor frame, encoding the input speech frame using a second predetermined encoding mode selected from said first set of encoding modes.

3. A method according to claim 2, wherein said second predetermined encoding mode is used to encode inactive speech frames according to the first speech coding scheme.

4. A method according to claim 2, wherein the first speech coding scheme comprises at least a quarter-rate encoding mode and an eighth-rate encoding mode, the quarter-rate encoding mode arranged to produce quarter-rate encoded speech frames having a certain first predetermined number of bits greater than the number of bits used to represent a silence descriptor frame in said second speech encoding scheme, the eighth-rate encoding mode arranged to produce eighth-rate encoded speech frames having a certain second predetermined number of bits less than the number of bits used to represent a silence descriptor frame in said second speech coding scheme, and when it is determined that the input speech frame is to be encoded as a silence descriptor frame, the input speech frame is encoded with a number of bits compatible with a silence descriptor frame according to the second speech coding scheme and is transmitted as a quarter-rate encoded speech frame.

5. A method according to claim 2, wherein the first speech coding scheme comprises a full-rate encoding mode arranged to produce full-rate encoded speech frames comprising a first number of bits, a half-rate encoding mode arranged to produce half-rate encoded speech frames having a second number of bits less than said first number of bits, a quarter-rate encoding mode arranged to produce quarter-rate encoded speech frames with a third number of bits less than said second number of bits and an eighth-rate encoding mode arranged to produce eighth-rate encoded speech frames with a fourth number of bits less than said third number of bits, the third number of bits being greater than the number of bits used to represent a silence descriptor frame in said second speech encoding scheme, the fourth number of bits being less than the number of bits used to represent a silence descriptor frame according to said second speech coding scheme, and when it is determined that the input speech frame is to be encoded as a silence descriptor frame, the input speech frame is encoded with a number of bits compatible with a silence descriptor frame of the second speech coding scheme and is transmitted as a quarter-rate encoded speech frame.

6. A method according to claim 3, wherein when it is determined that the inactive speech frame is not to be encoded as a silence descriptor frame, the input speech frame is encoded using said eighth-rate encoding mode.

7. A method according to claim 2, wherein the first speech coding scheme is conformed to CDMA rate set 2.

8. A method according to claim 2, wherein the first speech coding scheme is conformed to CDMA rate set 1.

9. A method according to claim 2, wherein the first speech coding scheme is defined according to a VMR-WB speech coding standard and the second speech coding scheme is defined according to an AMR-WB speech coding standard.

10. A method according to claim 4, wherein said first predetermined number of bits is 54 and said second predetermined number of bits is 20.

11. A method according to claim 5, wherein said first number of bits is 266, said second number of bits is 124, said third number of bits is 54 and said fourth number of bits is 20.

12. A method according to claim 10, wherein said first predetermined number of bits corresponds to a bit-rate of 2.7 kbits/s and said second predetermined number of bits corresponds to a bit-rate of 1.0 kbits/s.

13. A method according to claim 5, wherein said first number of bits corresponds to a bit-rate of 13.3 kbits/s, said second number of bits corresponds to a bit-rate of 6.2 kbits/s, said third number of bits corresponds to a bit-rate of 2.7 kbits/s and said fourth number of bits corresponds to a bit-rate of 1.0 kbits/s.

14. A method according to claim 10, wherein when it is determined that the input speech frame is to be encoded as a silence descriptor frame, the input speech frame is encoded with 35 bits, leaving 19 bits of said quarter-rate encoded speech frame unused.

15. A method according to claim 4, wherein the number of bits used to represent a silence descriptor frame according to the second speech coding scheme corresponds to 1 .75 kbits/s.

16. A method according to claim 2, wherein when consecutive input speech frames following an active speech period are determined to be inactive speech frames, thereby forming a sequence of inactive speech frames, said predetermined rule specifies that the first inactive speech frame of said sequence, the fourth inactive speech frame and thereafter every eighth inactive speech frame of said sequence is to be encoded as a silence descriptor frame.

17. A method according to claim 2, wherein when consecutive input speech frames following an active speech period are determined to be inactive speech frames, thereby forming a sequence of inactive speech frames, said predetermined rule specifies that a) the first inactive speech frame of said sequence is to be encoded as a silence descriptor frame, b) the next two inactive speech frames of said sequence are to be encoded using said second predetermined encoding mode, c) the fourth inactive speech frame of said sequence is to encoded as a silence descriptor frame, d) the next seven inactive speech frames are to be encoded using said second predetermined encoding mode and the following inactive speech frame is to be encoded as a silence descriptor frame and step d) is to be repeated until an active speech frame is detected.

18. A method according to claim 2, wherein when consecutive input speech frames following an active speech period are determined to be inactive speech frames, thereby forming a sequence of inactive speech frames, said predetermined rule specifies that the first inactive speech frame of said sequence is to be encoded as a silence descriptor frame and thereafter every eighth inactive speech frame of said sequence is to be encoded as a silence descriptor frame.

19. A method according to claim 2, wherein when consecutive input speech frames are determined to be inactive speech frames, thereby forming a sequence of inactive speech frames, said predetermined rule specifies that a) the first inactive speech frame of said sequence is to be encoded as a silence descriptor frame, b) the next k inactive speech frames of said sequence are to be encoded using said second predetermined encoding mode and the following inactive speech frame is to be encoded as a silence descriptor frame and step b) is to be repeated until an active speech frame is detected.

20. A method according to claim 19, wherein k is equal to 7.

21. A method according to claim 2, wherein when consecutive input speech frames following an active speech period are determined to be inactive speech frames, thereby forming a sequence of inactive speech frames, said predetermined rule specifies that an inactive speech frame is encoded as a silence descriptor frame when noise characteristics change.

22. An apparatus for encoding a speech signal according to a first speech coding scheme so that it can be decoded according to a second speech coding scheme, the speech signal comprising active speech periods during which there is active speech and inactive speech periods during which there is no active speech, the first speech coding scheme having a first set of available coding modes, each of said first set of coding modes having an associated encoding bit-rate, the second speech coding scheme having a second set of available coding modes including a discontinuous transmission coding mode in which silence descriptor frames are generated during inactive speech periods, the apparatus comprising:

an input for receiving a speech signal for encoding according to the first speech coding scheme;

a voice activity detector for determining whether a speech frame derived from said speech signal can be classified as an active speech frame containing active speech or an inactive speech frame that does not contain active speech;

an inactive speech frame processing unit operable to perform a determination operation on a speech frame classified as inactive according to a predetermined rule to specify whether, according to the second speech coding scheme, the inactive speech frame is to be encoded as a silence descriptor frame; and an encoding unit responsive to the determination operation performed by said inactive frame processing unit, operable to encode the input speech frame using a first predetermined encoding mode selected from said first set of available encoding modes when it is determined that the input speech frame is to be encoded as a silence descriptor frame, said first predetermined encoding mode having an encoding bit-rate sufficiently high to allow encoding of the input speech frame with a number of bits compatible with a silence descriptor frame according to the second speech coding scheme and operable to encode the input speech frame using a second predetermined encoding mode selected from said first set of encoding modes when it is determined that the input speech frame is not to be encoded as a silence descriptor frame.

23. An apparatus according to claim 22, wherein the first speech coding scheme comprises at least a quarter-rate encoding mode and an eighth-rate encoding mode, the quarter-rate encoding mode arranged to produce quarter-rate encoded speech frames having a certain first predetermined number of bits greater than the number of bits used to represent a silence descriptor frame in said second speech encoding scheme, the eighth-rate encoding mode arranged to produce eighth-rate encoded speech frames having a certain second predetermined number of bits less than the number of bits used to represent a silence descriptor frame in said second speech coding scheme, and the encoding unit is arranged to encode the input speech frame with a number of bits compatible with a silence descriptor frame according to the second speech coding scheme within a quarter-rate encoded speech frame when the inactive speech frame processing unit determines that the input speech frame is to be encoded as a silence descriptor frame.

24. An apparatus according to claim 22, wherein the first speech coding scheme comprises a full-rate encoding mode arranged to produce full-rate encoded speech frames comprising a first number of bits, a half-rate encoding mode arranged to produce half-rate encoded speech frames having a second number of bits less than said first number of bits, a quarter-rate encoding mode arranged to produce quarter-rate encoded speech frames with a third number of bits less than said second number of bits and an eighth-rate encoding mode arranged to produce eighth-rate encoded speech frames with a fourth number of bits less than said third number of bits, the third number of bits being greater than the number of bits used to represent a silence descriptor frame in said second speech encoding scheme, the fourth number of bits being less than the number of bits used to represent a silence descriptor frame according to said second speech coding scheme, and the encoding unit is arranged to encode the input speech frame with a number of bits compatible with a silence descriptor frame according to the second speech coding scheme within a quarter-rate encoded speech frame when the inactive speech frame processing unit determines that the input speech frame is to be encoded as a silence descriptor frame.

25. An apparatus according to claim 23, wherein the encoding unit is arranged to encode the input speech frame using said eighth-rate encoding mode when the inactive speech frame processing unit determines that the input speech frame is not to be encoded as a silence descriptor frame.

26. An apparatus according to claim 22, arranged to operate according to CDMA rate set 2.

27. An apparatus according to claim 22, arranged to operate according to CDMA rate set 1.

28. An apparatus according to claim 22, wherein the first speech coding scheme is defined according to a VMR-WB speech coding standard and the apparatus is arranged to enable interoperation with a second speech coding scheme defined according to the AMR-WB speech coding standard.

29. An apparatus according to claim 23, wherein said first predetermined number of bits is 54 and said second predetermined number of bits is 20.

30. An apparatus according to claim 24, wherein said first number of bits is 266, said second number of bits is 124, said third number of bits is 54 and said fourth number of bits is 20.

31. An apparatus according to claim 23, wherein said first predetermined number of bits corresponds to a bit-rate of 2.7 kbits/s and said second predetermined number of bits corresponds to a bit-rate of 1.0 kbits/s.

32. An apparatus according to claim 24, wherein said first number of bits corresponds to a bit-rate of 13.3 kbits/s, said second number of bits corresponds to a bit-rate of 6.2 kbits/s, said third number of bits corresponds to a bit-rate of 2.7 kbits/s and said fourth number of bits corresponds to a bit-rate of 1.0 kbits/s.

33. An apparatus according to claim 29, wherein when the inactive speech frame processing unit determines that the input speech frame is to be encoded as a silence descriptor frame the encoding unit is arranged to encode the input speech frame with 35 bits, leaving 19 bits of said quarter-rate encoded speech frame unused.

34. An apparatus according to claim 23, wherein the number of bits used to represent a silence descriptor frame according to the second speech coding scheme corresponds to 1.75 kbits/s.

35. An apparatus according to claim 22, wherein when the voice activity detector determines consecutive input speech frames following an active speech period to be inactive speech frames, thereby forming a sequence of inactive speech frames, the inactive speech frame processing unit determines according to said predetermined rule that the first inactive speech frame of said sequence, the fourth inactive speech frame and thereafter every eighth inactive speech frame of said sequence is to be encoded as a silence descriptor frame.

36. An apparatus according to claim 22, wherein when the voice activity detector determines consecutive input speech frames following an active speech period to be inactive speech frames, thereby forming a sequence of inactive speech frames, the inactive speech frame processing unit specifies according to said predetermined rule that a) the first inactive speech frame of said sequence is to be encoded as a silence descriptor frame, b) the next two inactive speech frames of said sequence are to be encoded using said second predetermined encoding mode, c) the fourth inactive speech frame of said sequence is to encoded as a silence descriptor frame, d) the next seven inactive speech frames are to be encoded using said second predetermined encoding mode and the following inactive speech frame is to be encoded as a silence descriptor frame and step d) is to be repeated until an active speech frame is detected.

37. An apparatus according to claim 22, wherein when the voice activity detector determines consecutive input speech frames following an active speech period to be inactive speech frames, thereby forming a sequence of inactive speech frames, the inactive speech frame processing unit determines according to said predetermined rule that the first inactive speech frame of said sequence is to be encoded as a silence descriptor frame and thereafter every eighth inactive speech frame of said sequence is to be encoded as a silence descriptor frame.

38. An apparatus according to claim 22, wherein when the voice activity detector determines consecutive input speech frames to be inactive speech frames, thereby forming a sequence of inactive speech frames, the inactive speech frame processing unit specifies according to said predetermined rule that a) the first inactive speech frame of said sequence is to be encoded as a silence descriptor frame, b) the next k inactive speech frames of said sequence are to be encoded using said second predetermined encoding mode and the following inactive speech frame is to be encoded as a silence descriptor frame and step b) is to be repeated until an active speech frame is detected.

39. An apparatus according to claim 38, arranged to set k equal to 7.

40. An apparatus according to claim 22, wherein when the voice activity detector determines consecutive input speech frames following an active speech period to be inactive speech frames, thereby forming a sequence of inactive speech frames, the inactive speech frame processing unit determines according to said predetermined rule that an inactive speech frame is encoded as a silence descriptor frame when noise characteristics change.

41. A circuit comprising:

an input for receiving a speech signal for encoding according to a first speech coding scheme for decoding according to a second speech coding scheme, the speech signal comprising active speech periods during which there is active speech and inactive speech periods during which there is no active speech, the first speech coding scheme having a first set of available coding modes, each of said first set of coding modes having an associated encoding bit-rate, the second speech coding scheme having a second set of available coding modes including a discontinuous transmission coding mode in which silence descriptor frames are generated during inactive speech periods;

a voice activity detector for determining whether a speech frame derived from said speech signal can be classified as an active speech frame containing active speech or an inactive speech frame that does not contain active speech;

an inactive speech frame processing unit operable to perform a determination operation on a speech frame classified as inactive according to a predetermined rule to specify whether, according to the second speech coding scheme, the inactive speech frame is to be encoded as a silence descriptor frame; and an encoding unit responsive to the determination operation performed by said inactive frame processing unit, operable to encode the input speech frame using a first predetermined encoding mode selected from said first set of available encoding modes when it is determined that the input speech frame is to be encoded as a silence descriptor frame, said first predetermined encoding mode having an encoding bit-rate sufficiently high to allow encoding of the input speech frame with a number of bits compatible with a silence descriptor frame according to the second speech coding scheme and operable to encode the input speech frame using a second predetermined encoding mode selected from said first set of encoding modes when it is determined that the input speech frame is not to be encoded as a silence descriptor frame.

42. A circuit according to claim 41, wherein the first speech coding scheme comprises a quarter-rate encoding mode and an eighth-rate encoding mode, wherein the quarter-rate encoding mode is arranged to produce quarter-rate encoded speech frames having a certain first predetermined number of bits greater than the number of bits used to represent a silence descriptor frame in said second speech encoding scheme;

wherein the eighth-rate encoding mode is arranged to produce eighth-rate encoded speech frames having a certain second predetermined number of bits less than the number of bits used to represent a silence descriptor frame in said second speech coding scheme; and wherein the encoding unit is arranged to encode the input speech frame with a number of bits compatible with a silence descriptor frame according to the second speech coding scheme within a quarter-rate encoded speech frame when the inactive speech frame processing unit determines that the input speech frame is to be encoded as a silence descriptor frame.

43. A circuit according to claim 41, wherein the first speech coding scheme comprises a full-rate encoding mode, a half-rate encoding mode, a quarter-rate encoding mode, and an eighth-rate encoding mode, wherein the full-rate encoding mode is arranged to produce full-rate encoded speech frames comprising a first number of bits;

wherein the half-rate encoding mode is arranged to produce half-rate encoded speech frames having a second number of bits less than said first number of bits;

wherein the quarter-rate encoding mode is arranged to produce quarter-rate encoded speech frames with a third number of bits less than said second number of bits;

wherein the eighth-rate encoding mode is arranged to produce eighth-rate encoded speech frames with a fourth number of bits less than said third number of bits, the third number of bits being greater than the number of bits used to represent a silence descriptor frame in said second speech encoding scheme, the fourth number of bits being less than the number of bits used to represent a silence descriptor frame according to said second speech coding scheme; and wherein the encoding unit is arranged to encode the input speech frame with a number of bits compatible with a silence descriptor frame according to the second speech coding scheme within a quarter-rate encoded speech frame when the inactive speech frame processing unit determines that the input speech frame is to be encoded as a silence descriptor frame.

44. A circuit according to claim 42, wherein the encoding unit is arranged to encode the input speech frame using said eighth-rate encoding mode when the inactive speech frame processing unit determines that the input speech frame is not to be encoded as a silence descriptor frame.

45. A circuit according to claim 41, arranged to operate according to CDMA rate set 2.

46. A circuit according to claim 41, arranged to operate according to CDMA rate set 1.

47. A circuit according to claim 41, wherein the first speech coding scheme is defined according to a VMR-WB speech coding standard, and where the second speech coding scheme is defined according to a AMR-WB speech coding standard.

48. A circuit according to claim 42, wherein said first predetermined number of bits is 54 and said second predetermined number of bits is 20.

49. A circuit according to claim 43, wherein said first number of bits is 266, said second number of bits is 124, said third number of bits is 54 and said fourth number of bits is 20.

50. A circuit according to claim 42, wherein said first predetermined number of bits corresponds to a bit-rate of 2.7 kbits/s and said second predetermined number of bits corresponds to a bit-rate of 1.0 kbits/s.

51. A circuit according to claim 43, wherein said first number of bits corresponds to a bit-rate of 13.3 kbits/s, said second number of bits corresponds to a bit-rate of 6.2 kbits/s, said third number of bits corresponds to a bit-rate of 2.7 kbits/s and said fourth number of bits corresponds to a bit-rate of 1.0 kbits/s.

52. A circuit according to claim 48, wherein when the inactive speech frame processing unit determines that the input speech frame is to be encoded as a silence descriptor frame the encoding unit is arranged to encode the input speech frame with 35 bits, leaving 19 bits of said quarter-rate encoded speech frame unused.

53. A circuit according to claim 42, wherein the number of bits used to represent a silence descriptor frame according to the second speech coding scheme corresponds to 1.75 kbits/s.

54. A circuit according to claim 41, wherein when the voice activity detector determines consecutive input speech frames following an active speech period to be inactive speech frames, thereby forming a sequence of inactive speech frames, the inactive speech frame processing unit determines according to said predetermined rule that the first inactive speech frame of said sequence, the fourth inactive speech frame and thereafter every eighth inactive speech frame of said sequence is to be encoded as a silence descriptor frame.

55. A circuit according to claim 41, wherein when the voice activity detector determines consecutive input speech frames following an active speech period to be inactive speech frames, thereby forming a sequence of inactive speech frames, the inactive speech frame processing unit specifies according to said predetermined rule that a) the first inactive speech frame of said sequence is to be encoded as a silence descriptor frame, b) the next two inactive speech frames of said sequence are to be encoded using said second predetermined encoding mode, c) the fourth inactive speech frame of said sequence is to encoded as a silence descriptor frame, d) the next seven inactive speech frames are to be encoded using said second predetermined encoding mode and the following inactive speech frame is to be encoded as a silence descriptor frame and step d) is to be repeated until an active speech frame is detected.

56. A circuit according to claim 41, wherein when the voice activity detector determines consecutive input speech frames following an active speech period to be inactive speech frames, thereby forming a sequence of inactive speech frames, the inactive speech frame processing unit determines according to said predetermined rule that the first inactive speech frame of said sequence is to be encoded as a silence descriptor frame and thereafter every eighth inactive speech frame of said sequence is to be encoded as a silence descriptor frame.

57. A circuit according to claim 41, wherein when the voice activity detector determines consecutive input speech frames to be inactive speech frames, thereby forming a sequence of inactive speech frames, the inactive speech frame processing unit specifies according to said predetermined rule that a) the first inactive speech frame of said sequence is to be encoded as a silence descriptor frame, b) the next k inactive speech frames of said sequence are to be encoded using said second predetermined encoding mode and the following inactive speech frame is to be encoded as a silence descriptor frame and step b) is to be repeated until an active speech frame is detected.

58. A circuit according to claim 57, arranged to set k equal to 7.

59. A circuit according to claim 41, wherein when the voice activity detector determines consecutive input speech frames following an active speech period to be inactive speech frames, thereby forming a sequence of inactive speech frames, the inactive speech frame processing unit determines according to said predetermined rule that an inactive speech frame is encoded as a silence descriptor frame when noise characteristics change.

60. An apparatus comprising:

means for inputting a speech signal to encode the speech signal according to a first speech coding scheme for decoding according to a second speech coding scheme, wherein the speech signal comprises active speech periods during which there is active speech and inactive speech periods during which there is no active speech, the first speech coding scheme having a first set of available coding modes, each of said first set of coding modes having an associated encoding bit-rate, the second speech coding scheme having a second set of available coding modes including a discontinuous transmission coding mode in which silence descriptor frames are generated during inactive speech periods;

means for detecting voice activity in a speech frame derived from the input speech signal to determine whether the speech frame is an active speech frame containing active speech or an inactive speech frame that does not contain active speech;

means to perform a determination operation according to a predetermined rule when it is determined that the input speech is an inactive speech frame, to determine if, according to the second speech coding scheme, the inactive speech frame is to be encoded as a silence descriptor frame; and means for encoding the input speech frame, when it is determined that the input speech frame is to be encoded as a silence descriptor frame, using a first predetermined encoding mode selected from said first set of available encoding modes that has an encoding bit-rate sufficiently high to allow encoding of the input speech frame with a number of bits compatible with a silence descriptor frame according to the second speech coding scheme; and means for encoding the input speech frame, when it is determined that the input speech frame is not to be encoded as a silence descriptor frame, using a second predetermined encoding mode selected from said first set of encoding modes.

61. An apparatus according to claim 60, wherein said second predetermined encoding mode is used to encode inactive speech frames according to the first speech coding scheme.

62. An apparatus according to claim 60, wherein the first speech coding scheme comprises a quarter-rate encoding mode and an eighth-rate encoding mode, further comprising:

means for producing quarter-rate encoded speech frames having a certain first predetermined number of bits greater than the number of bits used to represent a silence descriptor frame in said second speech encoding scheme;

means for producing eighth-rate encoded speech frames having a certain second predetermined number of bits less than the number of bits used to represent a silence descriptor frame in said second speech coding scheme; and where said encoding means operates, when it is determined that the input speech frame is to be encoded as a silence descriptor frame, for encoding the speech frame with a number of bits compatible with a silence descriptor frame according to the second speech coding scheme for transmitting as a quarter-rate encoded speech frame.

63. An apparatus according to claim 60, wherein the first speech coding scheme further comprises:

a full-rate encoding mode arranged to produce full-rate encoded speech frames comprising a first number of bits;

a half-rate encoding mode arranged to produce half-rate encoded speech frames having a second number of bits less than said first number of bits;

a quarter-rate encoding mode arranged to produce quarter-rate encoded speech frames with a third number of bits less than said second number of bits, the third number of bits being greater than the number of bits used to represent a silence descriptor frame in said second speech encoding scheme;

an eighth-rate encoding mode arranged to produce eighth-rate encoded speech frames with a fourth number of bits less than said third number of bits, and the fourth number of bits being less than the number of bits used to represent a silence descriptor frame according to a second speech coding scheme; and where said encoding means operates, when it is determined that the input speech frame is to be encoded as a silence descriptor frame, for encoding the speech frame with a number of bits compatible with a silence descriptor frame of the second speech coding scheme within a quarter-rate encoded speech frame for transmitting as a quarter-rate encoded speech frame.

* * * * *

UNITED STATES PATENT AND TRADEMARK OFFICE

CERTIFICATE OF CORRECTION

PATENT NO. : 7,203,638 B2
APPLICATION NO. : 11/039540
DATED : April 10, 2007
INVENTOR(S) : Jelinek et al.

It is certified that error appears in the above-identified patent and that said Letters Patent is hereby corrected as shown below:

IN THE CLAIMS:

In Claim 1: Column 27, line 61, delete "(I-FIR) " and replace with --(I-HR)--

Signed and Sealed this

Twelfth Day of June, 2007

JON W. DUDAS
*Director of the United States Patent and Trademark Office*